US008177299B2

(12) United States Patent
Fukai

(10) Patent No.: US 8,177,299 B2
(45) Date of Patent: May 15, 2012

(54) CHAIR MORE COMFORTABLE WHEN SEATED IN OPTIMUM POSTURE WHILE RECLINING

(75) Inventor: Zenroh Fukai, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 149 days.

(21) Appl. No.: 12/659,831

(22) Filed: Mar. 23, 2010

(65) Prior Publication Data

US 2010/0244522 A1 Sep. 30, 2010

(30) Foreign Application Priority Data

Mar. 27, 2009 (JP) ..... 2009-078539

(51) Int. Cl.
*A47C 1/024* (2006.01)
*A47C 1/038* (2006.01)
*A47C 3/026* (2006.01)

(52) U.S. Cl. ..... 297/300.2; 297/300.3; 297/300.4

(58) Field of Classification Search ..... 297/300.2, 297/300.3, 300.4, 300.5
See application file for complete search history.

(56) References Cited

U.S. PATENT DOCUMENTS

| | | | | |
|---|---|---|---|---|
| 4,198,094 | A * | 4/1980 | Bjerknes et al. | 297/300.4 |
| 4,408,800 | A * | 10/1983 | Knapp | 297/301.2 |
| 4,521,053 | A * | 6/1985 | de Boer | 297/312 |
| 4,589,697 | A * | 5/1986 | Bauer et al. | 297/301.2 |
| 4,765,679 | A * | 8/1988 | Lanuzzi et al. | 297/300.3 |
| 5,069,496 | A * | 12/1991 | Kunh et al. | 297/301.2 |
| 6,109,694 | A * | 8/2000 | Kurtz | 297/300.2 X |
| 6,149,236 | A | 11/2000 | Brauning | |
| 6,557,939 | B1 * | 5/2003 | Brauning | 297/300.2 X |
| 6,609,755 | B2 * | 8/2003 | Koepke et al. | 297/300.2 |

FOREIGN PATENT DOCUMENTS

JP 4037438 A 2/1992

OTHER PUBLICATIONS http://www.wilkhahn.co.jp/products/working/modus/function.html, "Modus: Function", Internet Watch, retrieved on Jun. 15, 2006.

* cited by examiner

*Primary Examiner* — Rodney B White
(74) *Attorney, Agent, or Firm* — Rabin & Berdo, PC

(57) ABSTRACT

A chair has a link of a chair back, a link of a chair seat, and a link mechanism that pushes up the link of the chair seat when the link of the chair back is pressed to incline rearward, so that the occupant can take the optimum seating posture without being conscious, thus further improving the comfort in the reclined posture.

17 Claims, 24 Drawing Sheets

CHAIR MORE COMFORTABLE WHEN SEATED IN OPTIMUM POSTURE WHILE RECLINING

BACKGROUND OF THE INVENTION

1. Field of the Invention

The present invention relates to a chair.

2. Description of the Background Art

A type of chairs such as office chairs has been proposed, of which the chair seat is moveable in linkage with the movement of the occupant to recline against the backrest. Specific examples are proposed in U.S. Pat. No. 6,149,236 to Brauning and Japanese patent laid-open publication No. 37438/1992. Another specific example can be found on the website of Wilkhahn, "Modus: Function" [[ ]], Internet Watch, retrieved on Jun. 15, 2006.

A conventional chair will briefly be described. An example of conventional chair has a base that comprises a support stem or stems and caster wheels, and is to be settled on the floor surface. The base is formed so as to bear the weight of the entire chair and the occupant who would be seated thereon. On top end of the base, a chair seat is swivelably mounted on which the occupant is to be seated. The base has its intermediate portion provided with an articulation to which a first link is pivotally connected at its one end so as to support the occupant, when seated thereon.

The first link is formed to bend at a predetermined angle to support the chair seat and the chair back. The chair back has a backrest attached to the first link. The first link and the chair seat are connected to each other by a second link, which has its opposite ends linked with respective articulations to swivelably support the chair seat with respect to the first link.

When the occupant is seated on the chair and reclines against the chair back, the first link that supports the chair back swivels about the articulation with respect to the base. The chair seat is connected to the first link by the second link, and therefore swivels about the articulation relative to the base simultaneously with the first link. That is, the mechanism is constituted such that the chair seat can be inclined rearward by an amount associated with the rearward inclination of the chair back.

With the conventional chair, however, since the chair seat is inclined rearward by an amount associated with the amount by which the chair back is inclined rearward, the angle between the chair seat and the chair back does not increase beyond the amount by which the chair back is inclined rearward, thus making it impossible for the occupant to keep his or her optimum seating posture. More specifically, when the occupant sits on the chair seat and wants to take a relaxed reclined position, comfort of the occupant may be compromised in some cases due to the lack of the angle between the chair seat and the chair back.

In order to mitigate such an inconvenience, the occupant often sits with the rear of the body shifted toward the front of the chair seat in the reclined posture, and extends his or her hip joint. However, this posture may be against the social behavior of deeply sitting on the chair seat for proper seating posture. For this reason, the sitters tend to impose the increased stress on his or her buttocks and other parts of the body.

SUMMARY OF THE INVENTION

It is therefore an object of the present invention to provide a chair that allows the occupant to take the optimum seating posture with his or her awareness minimized and ensures increased comfort when seated in reclined position.

The present invention provides a chair comprising a chair back and a chair seat, the chair having a lifting mechanism that pushes up a link of the chair seat upward in response to a force that causes a link of the chair back to incline rearward.

In accordance with the chair of the present invention, the link of the chair seat is pushed upward when the occupant reclines against the chair back, and therefore the angle formed between the link of the chair seat and the link of the chair back can be rendered larger than that of the convention chair, thus allowing the occupant to be seated comfortably in an optimum reclined position. Thus, the present invention provides a chair that causes comfortable seating.

BRIEF DESCRIPTION OF THE DRAWINGS

The objects and features of the present invention will become more apparent from consideration of the following detailed description taken in conjunction with the accompanying drawings in which:

FIG. 5 is a schematic side view, like. FIG. 1, showing the constitution of an alternative embodiment of the chair in accordance with the present invention;

DESCRIPTION OF THE PREFERRED EMBODIMENTS

Figure 1:
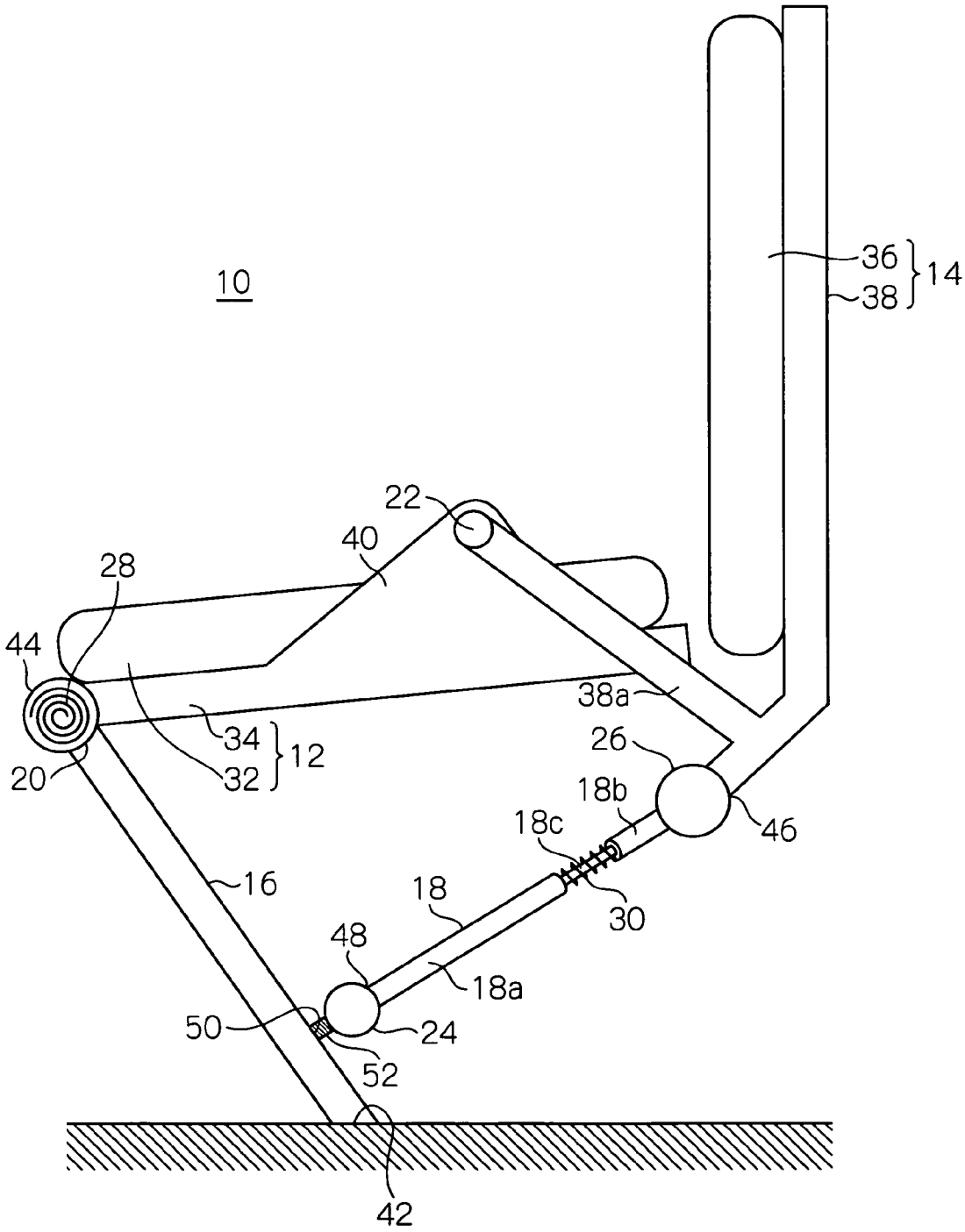
FIG. 1 is a schematic side view of the constitution of an embodiment of the chair in accordance with the present invention.

Embodiments of the chair in accordance with the present invention will be described in detail below with reference to the accompanying drawings. With reference first to FIG. 1, a chair 10 in accordance with an illustrative embodiment of the invention has a link mechanism that is responsive to a force implied in a direction of inclining a link 38 of a chair back 14 rearward, i.e. left in the figure, to push a link 34 of a chair seat 12 upward in the figure.

When the occupant, not shown, reclines against the chair back 14 of the chair 10, the link 34 of the chair seat 12 is pushed upward in response to the occupant's reclining. As a result, it is made possible to make the angle formed between the link 34 of the chair seat 12 and the link 38 of the chair back 14 larger than that in the conventional chair, thus allowing the occupant, or sitter, to be reclined comfortably in an optimum position. Accordingly, a chair more comfortable to sit can be provided.

As shown in FIG. 1, the chair 10 comprises a linkage 18, articulations, or joints, 20, 22, 24 and 26, helical springs 28 and a compressive coil spring 30 in addition to the chair seat 12, chair back 14 and base member 16. FIG. 1 shows only the components that are necessary for understanding the constitution of the chair 10.

The chair 10 has thus the chair seat 12 and the chair back 14. Hence, the chair seat 12 may include a shock absorbing member, or padding, 32 such as a cushion, disposed at a position where the occupant is seated, and a link 34 that supports the occupant when seated. Also, the chair back 14 may include a shock absorbing member, padding, 36 such as a cushion on which the occupant leans, and a link 38 that supports the occupant who leans thereon.

Description that follows will deal with the link mechanism in which the links 34 and 38 and the members associated therewith are connected, without mentioning the shock absorbing members 32 and 36 of the chair seat 12 and the chair back 14. The link 34 of the chair seat 12 bulges in its portions that correspond to both sides of the occupant when seated on the chair 10 so as to form side parts 40 that rise upward. The side parts 40 are connected to the link 38 of the chair back 14 by the articulations 22.

The base member 16 supports the weight of the chair 10 plus the weight of the occupant who is seated on the chair seat 12. The base member 16 of this embodiment has its one end 42 placed on the floor surface and its other end 44 connected to the link 34 by the articulations 20. The articulations 20 may preferably be a hinge joint. Connecting in this way allows the link 34 to swivel, or pivot, about the articulations 20. The link 34 can swing vertically about the articulations 20. In this embodiment, a helical spring may be applied to the articulations 20 for producing elastic force.

The chair back 14 supports the back of the occupant, when seated on the chair seat 12, from behind. As described above, the link 38 of the chair back 14 is connected to the side parts 40 of the link 34 by the articulations 22 at the positions corresponding to the sides of the occupant. The chair back 14 has an articulation 26 disposed at the end 46 as shown in FIG. 1. Connected to the articulation 26 at the end 46 is one end of a linkage 18. The linkage 18 has its other end 48 connected to the articulation 24. To the articulation 24, a fastening member 52 is connected.

The fastening member 52 is secured onto an end 50 of the base member 16 by threading. Thus, the link 38 is secured onto the base member 16 by the fastening member 52 via the linkage 18.

The articulations 22 may be a hinge joint, which is adapted to swivel, as the occupant is seated, by means of the same link mechanism as described previously. As a result, the links 34 and 38 are allowed to move from the back rest 36 forward, namely to the left in the figure, up to a position at a predetermined distance. The articulations 22 at disposed at respective positions that substantially correspond to the hip joint of the occupant when the occupant is seated on the chair seat 12.

The articulation 26 firmly engages the link 38 with the linkage 18 so as to allow the link 38 and the linkage 18 to swivel by means of a swiveling mechanism. The linkage 18 includes two parts 18*a* and 18*b*, and an elongate support bar 18*c* formed to extend from one part 18*a* of the linkage 18 in the longitudinal direction. The other part 18*b* of the linkage 18 has a recess, not shown, formed for the purpose of receiving the support bar 18*c* slidably in the longitudinal direction. The compressive coil spring 30 is inserted over the support bar 18*c* of the linkage 18. The linkage 18 thus constitutes a shock absorber mechanism that utilizes the compressive coil spring 30. The compressive coil spring 30 contracts along the linkage 18 so as to generate an elastic force that acts in the direction opposite to the contracting direction. The articulation 26 may be implemented by a hinge joint, for example, of which a specific action will be described later.

As described previously, attached to the base member 16 is the articulation 24 by an appropriate link mechanism at the fastening position 50. The articulation 24 is connected to the linkage 18. The link mechanism also serves to adjust the distance between the articulation 24 and the base member 16. In case there is no need to keep the distance between the articulation 24 and the base member 16, then the link mechanism may be the articulation 24 per se.

Figure 2A:
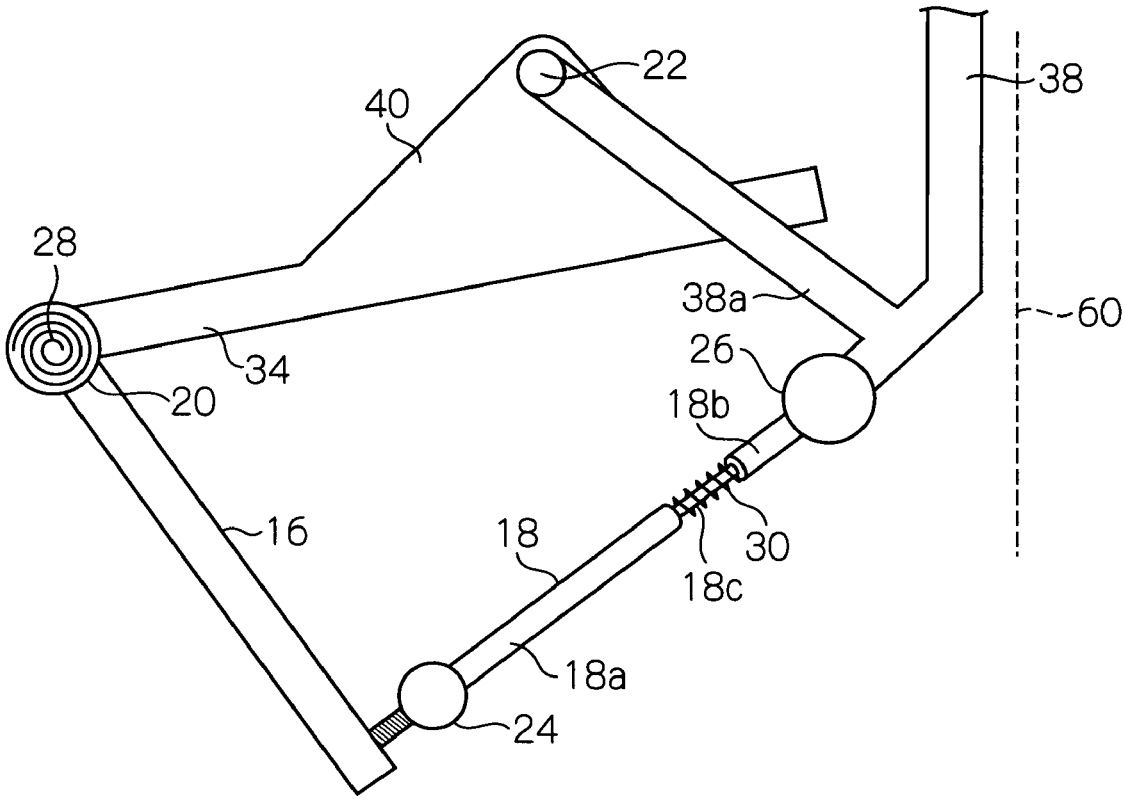
FIG. 2A is a side view of the key portion of the chair shown in FIG. 1 before the occupant is seated thereon.
Figure 2B:
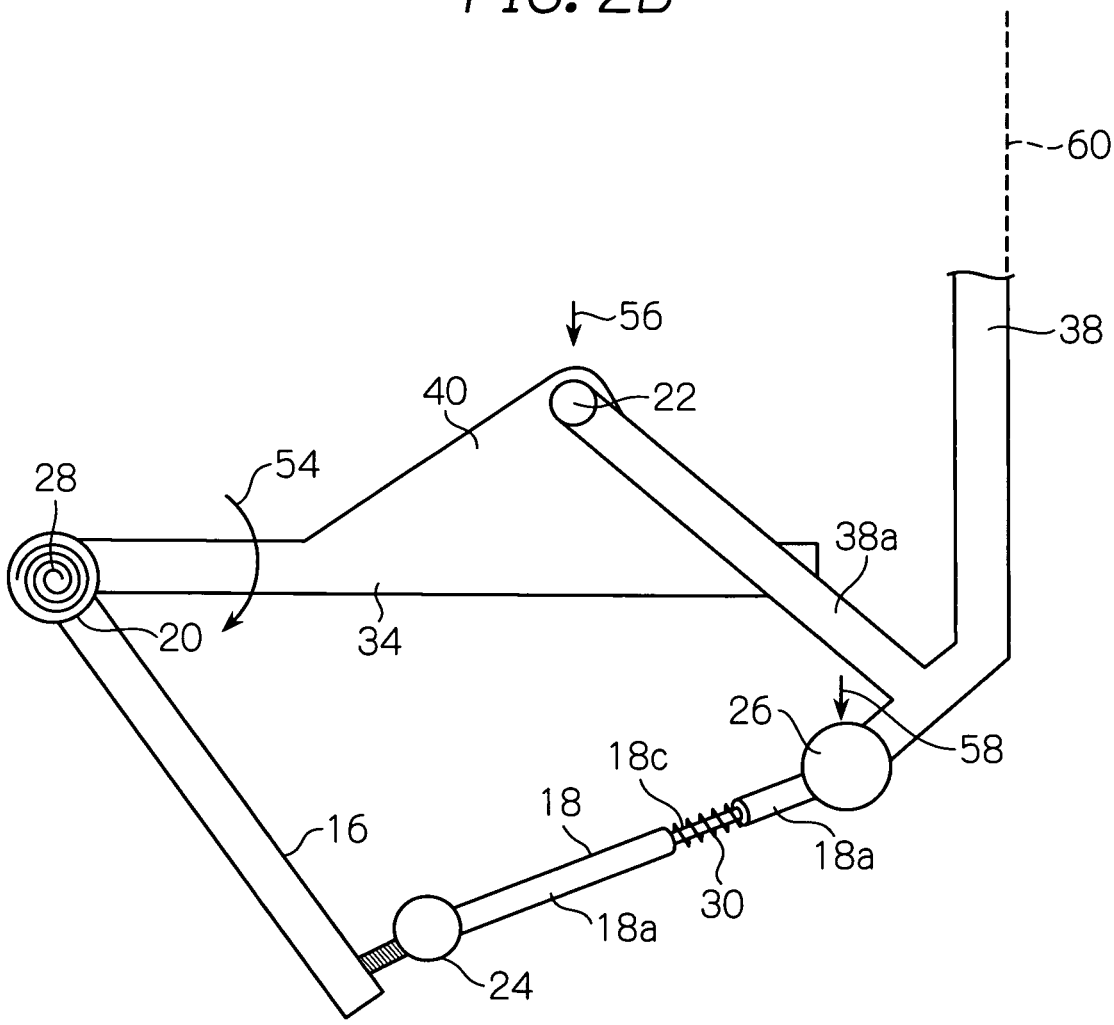
FIG. 2B is a side view of the key portion of the chair shown in FIG. 1 on which the occupant is seated but not reclined against the backrest.
Figure 2C:
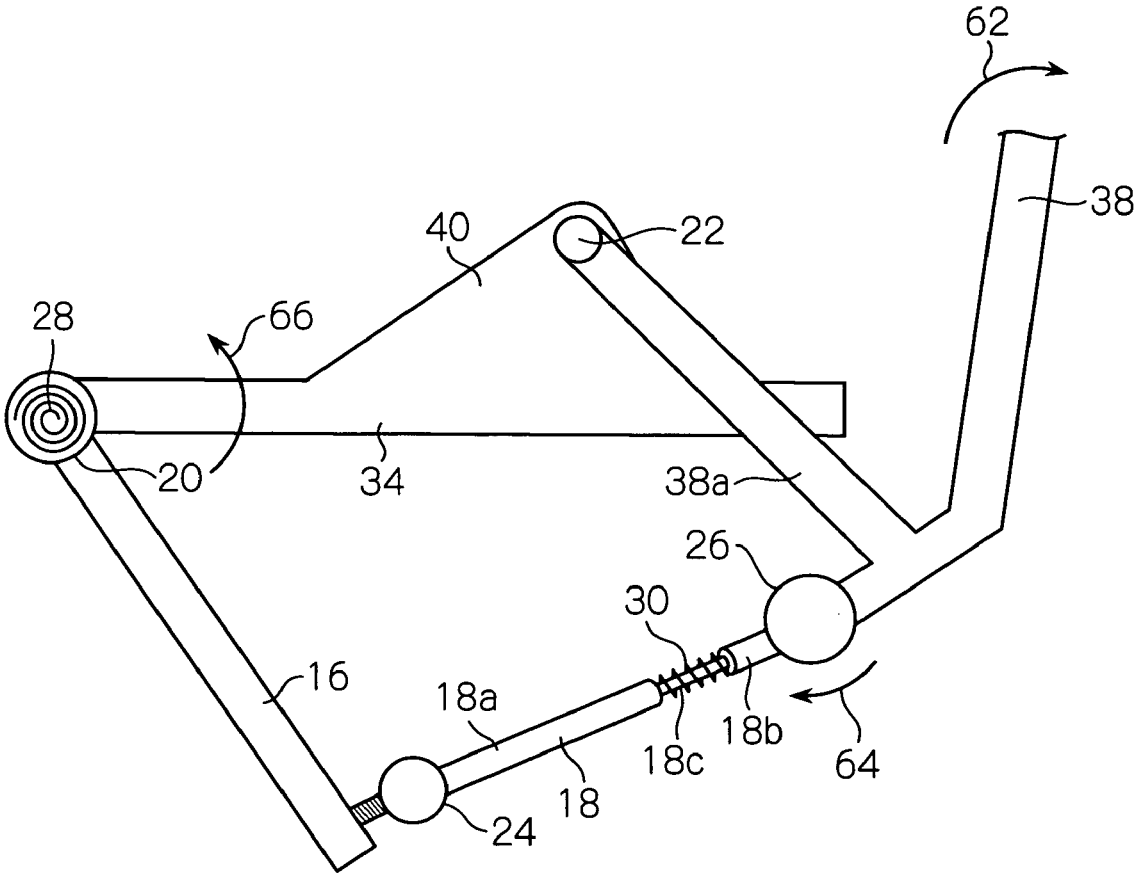
FIG. 2C is a side view of the key portion of the chair shown in FIG. 1 on which the occupant is seated and reclined against the backrest.

Now, the movement of those components when the occupant is seated on the chair seat 12 of the chair 10 will be described. FIGS. 2A, 2B and 2C, show how the components displace when the occupant is seated on the shock absorbing member 34 of the chair seat 12 and reclines against the shock absorbing member 36 of the chair back 14. FIGS. 2A, 2B and 2C are side views of the key portion of the chair 10 shown in FIG. 1. In the figures, like components are designated with the same reference numerals, and a repetitive description will be omitted to avoid the intricacy of duplicate description.

FIG. 2A shows the state before the occupant is seated on the chair seat 12. The state shown in this figure is the same as the state shown in FIG. 1. FIG. 2B shows the state in which the occupant is seated on the chair seat 12 but not yet reclined against the chair back 14.

When the occupant is seated on the chair seat 12, the chair seat 12 swivels in the direction of an arrow 54 while subsiding about the articulations 20. As the chair seat 12 subsides, the articulations 22 move downward as indicated by an arrow 56.

The link 38 of the chair back 14 is connected by the articulations 22 to the link 34 of the chair seat 12 swivelably. Connected to the link 38 is the linkage 18 which extends between the articulation 24 connected to the base member 16 and capable of swiveling and the articulation 26 connected to the link 38. That is, the chair 10 forms the link mechanism where the articulations 20, 22, 24 and 26 function as rotation axes. As a result, the action of the link 38 is determined by the characteristic of the link mechanism.

Figure 3:
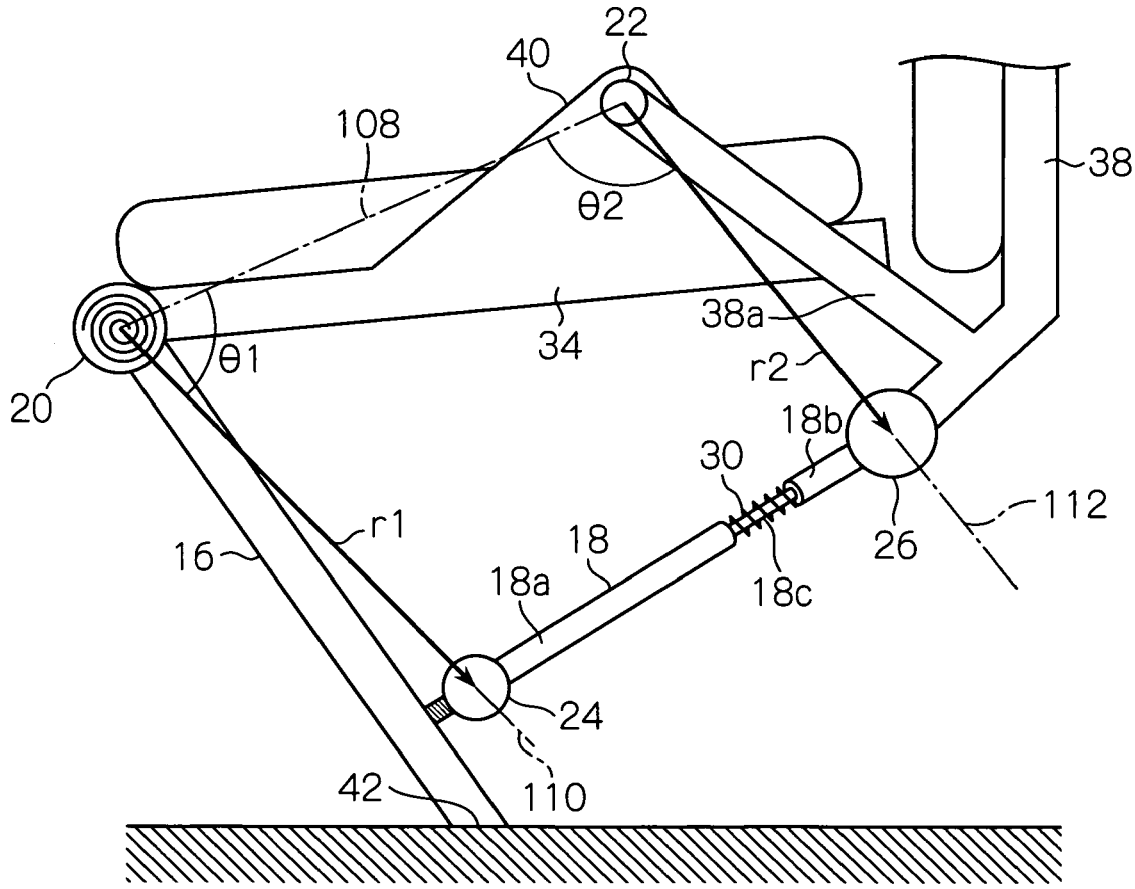
FIG. 3 is a diagram schematically showing forces that act on the chair shown in FIG. 1.

When active forces r1 and r2 satisfy the relationships r1=r1 and r1//r2 as shown in FIG. 3, the four articulations 20 through 26 and the links 34 and 38 function as parallel link mechanism, which makes the distance over which the articulations 22 move downward as the link 34 subsides substantially equal to the distance over which the articulation 26 moves downward.

Now, with reference to FIG. 2B again, the articulations 22 and 26 move in the directions of the arrows 56 and 58, respectively. Inclination of the link 38 remains the same value as before the occupant is seated, as will be apparent by comparing a dotted line 60 and the position of the link 38 shown in FIGS. 2A and 2B.

As the link 34 subsides, the angle between the link 34 and the base member 16 decreases. At this time, the helical springs 28 incorporated in the articulations 20 generate elastic forces active in the direction of restoring this angle, namely a resisting force acting in a direction opposite to the arrow 54. The link 34 stops swiveling when the occupant's weight and the elastic force balance each other, and the subsiding motion will stop.

At this time, the seating posture of the occupant is established. Compared to the state before the occupant is seated, the link 34 swivels about the articulations 20 so as to subside. In the meantime, since inclination of the link 38 remains the same value as before the occupant is seated, the angle between the link 34 and the link 38 decreases. This results in the occupant feeling that the link 38 would automatically approach the back of the occupant so as to fit therewith. In other words, optimum seating posture will obtained whenever the occupant simply sits on the seat.

Then, the occupant reclines against the chair back 14 as shown in FIG. 2C. When the occupant reclines against the chair back 14, the link 38 swivels in the direction of an arrow 62 about the articulations 22 as shown in FIG. 2C.

When the link 38 swivels in the direction of an arrow 62, the articulation 26 moves toward the front of the occupant while swiveling in the direction of an arrow 64 shown in FIG. 2C. Accordingly, the link 38 presses the compressive coil spring 30. The compressive coil spring 30 exerts an elastic force in the direction of the occupant's back in resistance to the pressing force. The link 38 stops inclining when the force of the occupant to recline against the chair back 14 is balanced by this elastic force, so that the reclining posture of the occupant is fixed.

Incase the occupant further reclines against the chair back 14 to cause the compressive coil spring 30 to produce an elastic force stronger than a level at which the linkage 18 can be regarded as a mere link, the link mechanism acts to increase the torque in the articulations 20 to push the link 34 of the chair seat 12 upward. This causes the link 34 to swivel in the direction of an arrow 66 about the articulations 20. As a result, the angle formed between the link 34 and the link 38 increases so that the amount of expansion of the hip joint of the occupant increases during the reclining action, thereby making it possible to keep a posture that gives highly open feeling. When the occupant stands up, the link 34 is caused to swivel in the direction of the arrow 66 by the restoring force of the helical spring 28 so as to push the occupant upward and help the occupant in standing up.

The chair 10 of the instant illustrative embodiment can help the occupant in a series of actions from seating to standing up, as described below. As the link 34 inclines forward with the rear edge of the link 34 rising up, the occupant is supported by the seat surface from the early stage of seating, so that the occupant is relieved of stress on his or her body, particularly on the buttocks. Also because the chair seat 12 has its apparent depth shorter before the occupant is seated thereon, the occupant can easily find the seating position and be seated deeper toward the rear of the chair seat 12. As a result, the occupant can be seated in a proper posture. At this time, although the chair seat 12 is inclined forward, the chair back 14 rises substantially at right angles with respect to the ground, and it is therefore easy for the occupant to fit the back when seated on the chair 10.

When the occupant is seated, the angle between the link 34 of the chair seat 12 and the link 38 of the chair back 14 decreases, so that the shock absorbing member 32 automatically follows the contour of the back of the occupant. As the link 38 is inclined further rearward, the links 34 and 38 move in accordance with the posture of the occupant so as to keep the occupant in the optimum posture.

In case the modulus of elasticity of the compressive coil spring 30 is set to a value of reactive elastic force which is stronger than a level at which the linkage 18 can be regarded as a mere link, the link 34 is pushed upward when the link 38 is inclined rearward, so that the angle between the link 34 and the link 38 increases, thus making it possible for the occupant to extend his or her body and take a relaxed posture.

When the occupant stands up, the link 34, by the action of the helical spring 28, presses him or her upward to help him or her in standing up.

Figure 4:
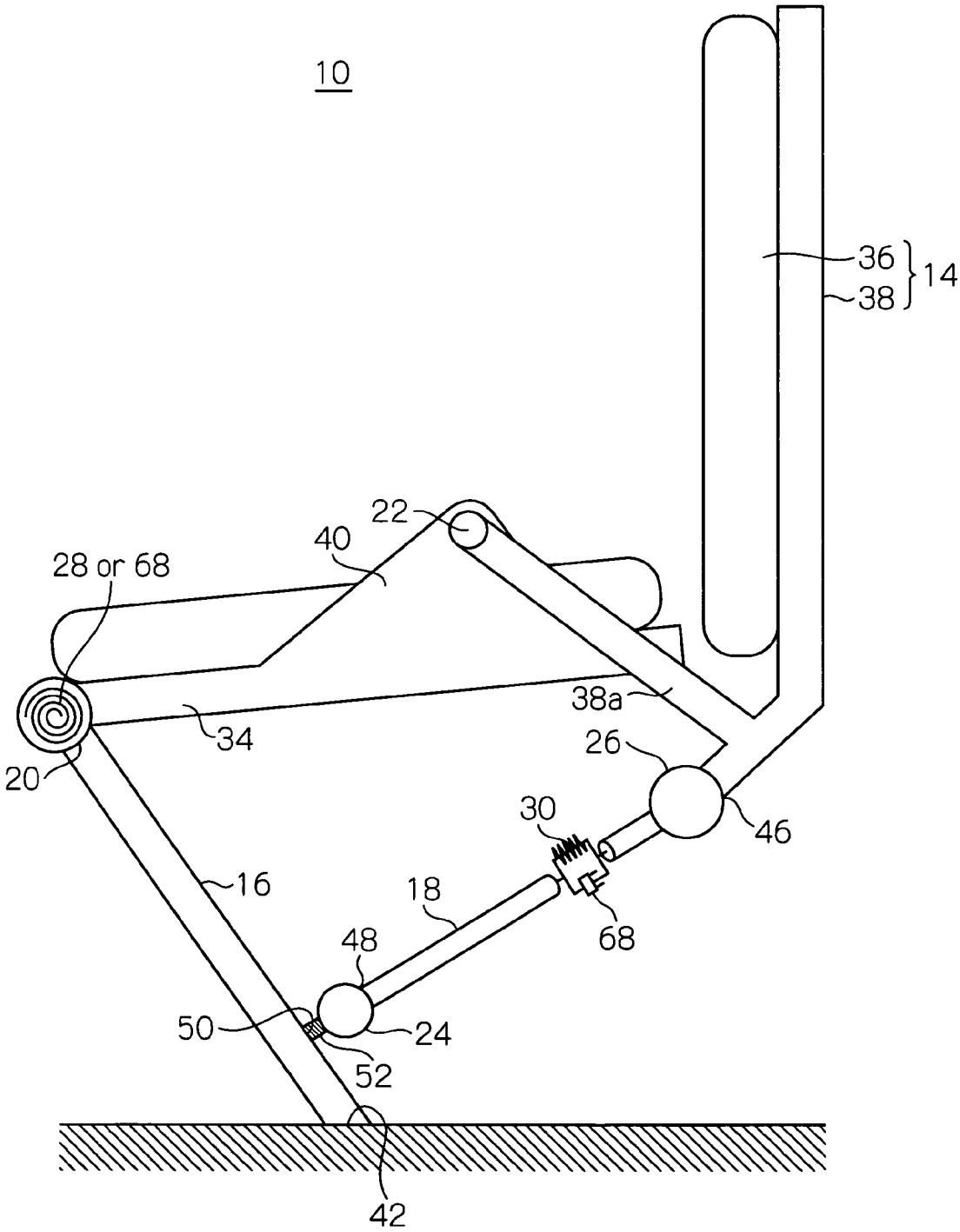
FIG. 4 is a schematic side view of the constitution of the chair shown in FIG. 1 where a hydraulic shock absorber is applied.

The present invention has been described by way of embodiment wherein the helical spring 28 is incorporated into the articulations 20, although the invention is not limited to the use of the helical spring 28 and the compressive coil spring 30, which may be replaced with a hydraulic shock absorber 68 as shown in FIG. 4. The hydraulic shock absorber 68 exerts a resisting force against swiveling motion by making use of viscous resistance and, when contracting or expanding motion occurs, resists the contraction or expansion.

Use of the hydraulic shock absorber 68 makes it possible to cause the subsiding motion to proceed slowly when the occupant is seated on the chair seat 12, thus causing soft feel of seating, making the reclining motion slower when the occupant reclines against the chair back 14 and providing soft support on the back.

It need not to say that optimum feel of fitting can be obtained between the occupant and the chair back when he or she is seated and when he or she reclines, by proper selection of the forces represented by the vectors r1 and r2, and properly setting the helical spring 28, the compressive coil spring 30 and the hydraulic shock absorber 68 of the link mechanism.

Another alternative embodiment of the chair of the present invention will be described below with reference to FIG. 5. The chair 10 of the illustrative embodiment described above relies upon the relation of r1=r2 being satisfied in order to achieve its functions. This, however, requires for the base member 16 longer than usual. That may make it difficult to design the chair 10 having the chair seat 12 positioned at the height as comparable as the typical popliteal height. In order to solve this problem, the instant alternative embodiment is resultant from introducing an auxiliary link mechanism into the illustrative embodiment described above so as to reduce the size of the mechanism provided beneath the chair seat 12 to thereby lower the chair seat 12 to the height comparable to the ordinary chairs.

Description that follows will deal with the components in the key portion of the chair 10 of the instant alternative embodiment. The link 34 has side parts 40 formed to rise with respect to the seated occupant from the link 34 similarly to the previous embodiment. The side parts 40 are connected to the link 38 on its branches 38*a* by the corresponding articulations 22. In this embodiment, additional links 70 and 72 and articulations 74, 76 and 78 are provided and applied to the link mechanism as described on the previous embodiment to form an auxiliary link mechanism anew so as to make it possible to reduce the size of the mechanism provided beneath the chair seat 12 and position the chair seat 12 at the height comparable to that of the ordinary chairs. The articulations 74, 76 and 78 may be implemented by hinge joints, for example.

The auxiliary link mechanism has a recess formed at a position 80 in the bottom surface of the link 34 to be mated in shape with the articulation 74 so as to receive the articulation 74, which connects the links 34 and 70 to each other. The articulation 74 is connected to one end of the link 70 so as to swivel in response to the motion of the link 70. The link 70 has its other end connected to the articulation 76 disposed on the link 72. The link 72 is connected by the articulation 78 to the linkage 18. The link 72 also has the articulation 24 provided thereon. Since the link 72 has the articulations 76, 78 and 24 disposed thereon, it may preferably be made of a triangular frame or a plate member of triangular shape that includes these members. The auxiliary link mechanism supports the link 34 from below, as shown in FIG. 5, by means of the links 70 and 72 having the articulations 74, 78 and 24 generally disposed in linear.

The base member 16 has a function to support the weight of the chair 10 and the weight of the occupant when seated on the chair seat 12. The articulations 20 connect the link 34 and the base member 18 together, and allow the chair seat 12 to swivel about the articulations 20. As a result, the chair seat 12 can swing up and down about the articulations 20. The articulations 20 of this alternative embodiment do not have the helical spring 28 unlike the previous embodiment. The weight of the occupant is supported by means of the helical spring 28 or the hydraulic shock absorber 68 provided for the articulation 24 of the auxiliary link mechanism, as will be described later.

The link 38 supports the back of the occupant when seated on the chair seat 12 from behind, namely by the backrest. The link 38 has the branches 38*a* formed. The branched links 38*a* are connected at the position where the articulations 22 are disposed on the side parts 40 of the link 34. The linkage 18 has its other end connected to the link 38 by the articulation 26.

The articulations 22 are swivelably disposed at a position apart from the chair seat 12 by a predetermined distance and from the backrest 36 of the chair back 14 toward the front by a predetermined distance. The articulations 22, in particular, are formed at a position that generally corresponds to the hip joint of the occupant when he or she is seated on the chair 10.

The auxiliary link mechanism of the chair 10 is disposed as a whole beneath the chair seat 12, and is constituted so as to connect the chair back 14 and the base member 16 together. The articulation 74 swivelably connects the bottom side of the link 34 to the link 70. The link 70 has its other end connected to the link 72 by the articulation 76. The link 72 may be, for example, a metal plate having the articulations 76, 78 and 24 arranged thereon.

The link 72 is formed in a substantially triangular shape in this embodiment also, but may otherwise be of an oval or other shape. The link 72 may be formed from a material other than metal, such as a resin or ceramic, so far as the positional relationship of the three articulations can be maintained.

To the base member 16, the articulation 24 is connected by an appropriate connection mechanism. The connection mechanism performs also the function to adjust the distance between the articulation 24 and the base member 16 at the same time. When it is not necessary to keep the distance between the articulation 24 and the base member 16, the connection mechanism may be accomplished by the articulation 24 per se.

The articulation 24 may be implemented by the helical spring 28, a torsion spring or the hydraulic shock absorber 68 that exerts urging force in a direction opposite to the pivotal direction of the articulation 24.

To the link 38, the articulation 26 swivelably connects the linkage 18, which is disposed beneath the chair seat 12, namely substantially in parallel to the link 34. The linkage 18 has its one end connected to the link 38 by the articulation 26 similarly to the previous embodiment. The linkage 18 has its other end swivelably connected to the link 72 by the articulation 78. The compressive coil spring 30 provided on the linkage 18 has the function of generating an elastic force in the direction along the linkage 18 in response to the reclining motion of the occupant. The articulation 26 swivelably connects the linkage 18 to the link 38.

Now, the motion of the various components when the occupant is seated on the chair 10 will be described with reference to FIGS. 6A, 6B and 6C which are side views of the key portion of the chair 10. FIG. 6A shows the state before the occupant is seated on the chair 10. FIG. 6A shows the states similar to the states of the components shown in FIG. 5.

Figure 6A:
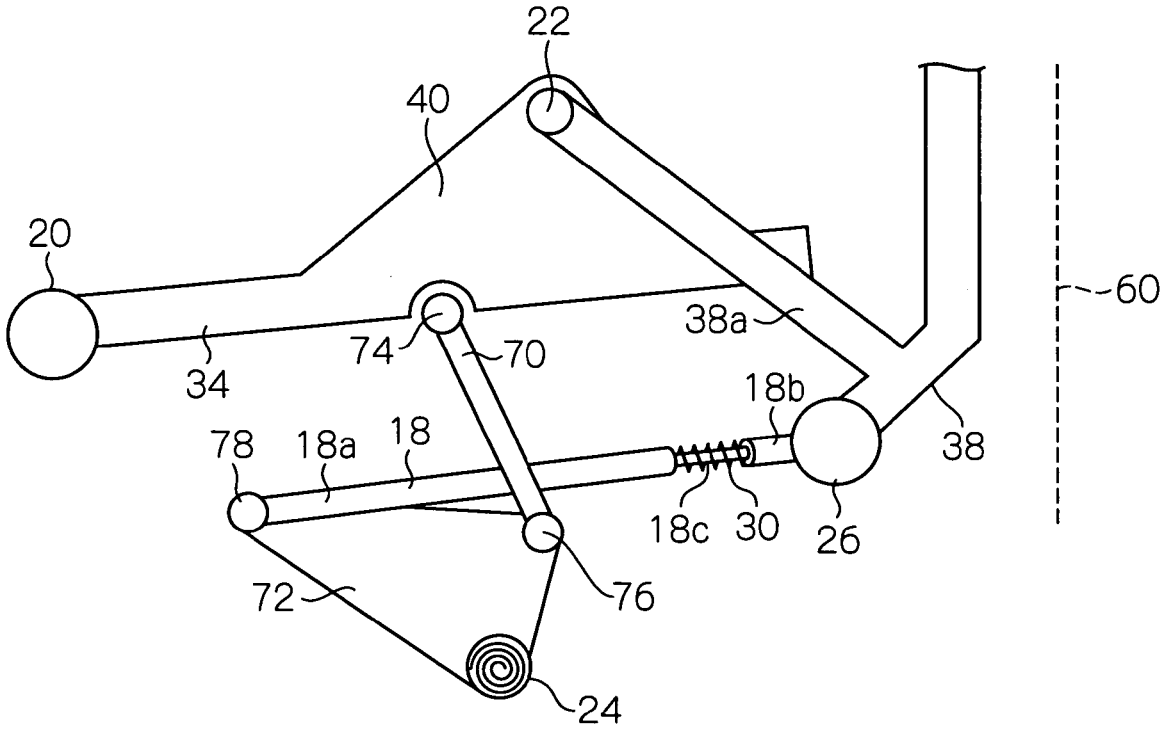
FIG. 6A is a schematic side view, like FIG. 2A, of the key portion of the chair shown in FIG. 5 before the occupant is seated thereon.
Figure 6B:
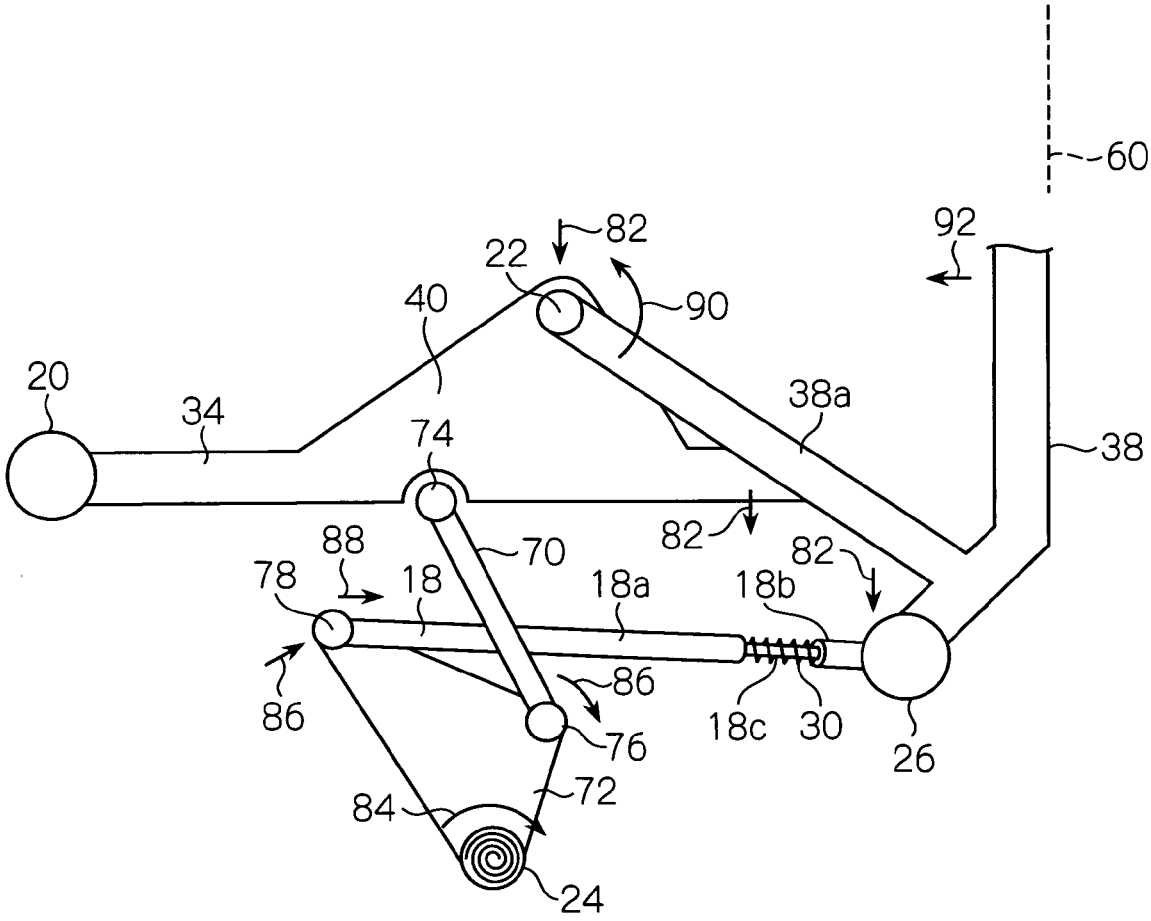
FIG. 6B is a schematic side view, like FIG. 2B, of the key portion of the chair shown in FIG. 5 on which the occupant is seated but not reclined against the backrest.

FIG. 6B shows the state after the occupant has been seated on the chair seat but is not yet reclined against the chair back 14. When the occupant sits on the chair seat 12, the chair seat 12 swivels about the articulations 20 while subsiding. At this time, the link 70 that supports the link 34 on its bottom surface receives a force acting downward as indicated by an arrow 82 as the occupant is seated. The link 70 is connected to the link 72 by the articulation 76, and is connected to the base member 16 swivelably by the articulation 24.

This connection causes the link 72 to swivel in the direction of an arrow 84 about the articulation 24. In conjunction with this swiveling motion, the articulation 76 also swivels in the direction of an arrow 86, namely clockwise in the figure. As the articulation 24 swivels clockwise, the helical spring 28 disposed therein stores the elastic force energy acting in the direction opposite to the clockwise swiveling. This elastic force energy causes the link 72 to swivel counterclockwise so as to cancel the displacement generated by the swiveling. As a result, the link 72 acts to push the link 70 upward through the swiveling caused by the elastic force. Subsiding motion of the chair seat 12 stops once the weight of the occupant and the elastic force are balanced.

As the link 72 swivels clockwise about the articulation 24, the linkage 18 pushes the link 72 upward in the direction of an arrow 86, thereby pressing the link 38 in the direction of an arrow 88, namely toward the backrest, by the articulations 78 an and 26. This pressing motion causes the link 38 to swivel in the direction of an arrow 90 about the articulations 22. At the same time, the angle between the link 34 and the link 38 decreases. That is, the link 38 is directed in the direction of an arrow 92. The seating posture of the occupant is established at this point of time.

Thus, the occupant may advantageously feel, when sitting on the chair seat 12, that the chair back 14 automatically approaches, and fits with, his or her back. As a result, the optimum seating posture is obtained for the occupant simply by seating on the chair seat 12, without pressing the chair back 14 in order to adjust the seating posture.

Figure 6C:
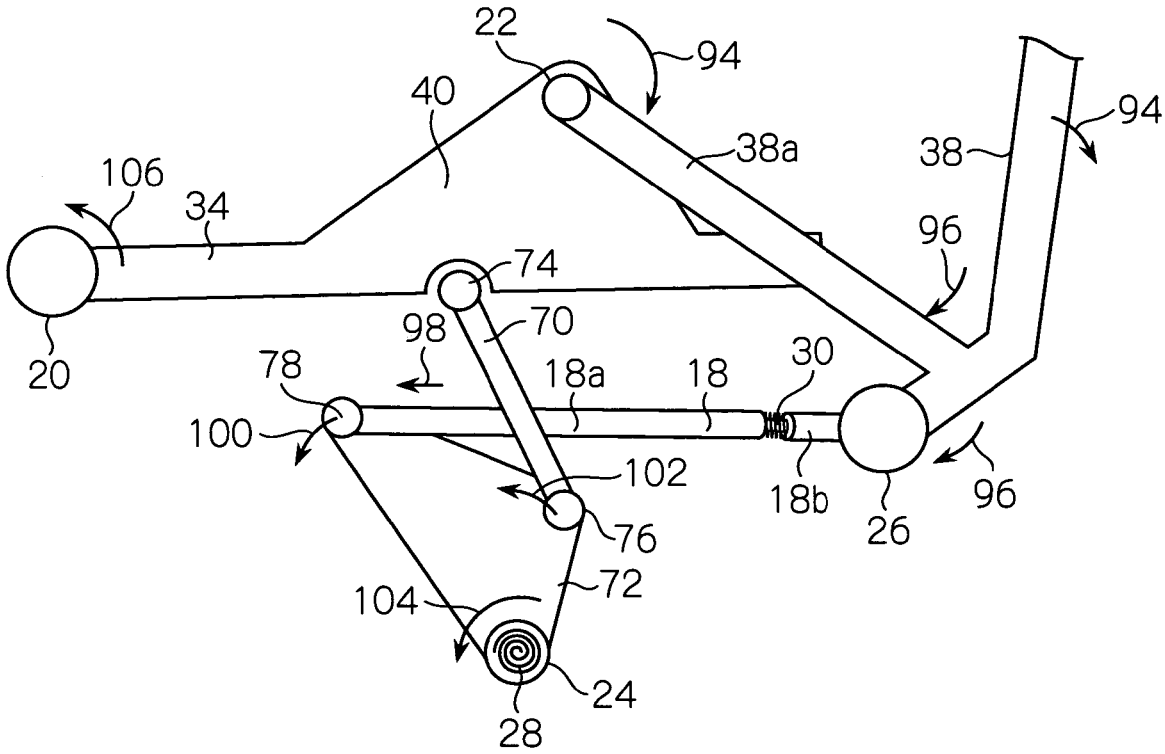
FIG. 6C is a schematic side view, like FIG. 2C, of the key portion of the chair shown in FIG. 5 on which the occupant is seated and reclined against the backrest.

FIG. 6C shows the state in which the occupant sits on the chair seat 12 and reclined against the chair back 14. When the occupant reclines against the chair back 14, the link 38 swivels about the articulations 22 in the direction of an arrow 94, namely clockwise.

As the link 38 swivels clockwise, the articulation 26 moves substantially to the left in FIG. 6C, i.e. toward the front of the occupant as indicated by an arrow 96. This swiveling motion compresses the compressive coil spring 30, so that the compressive coil spring 30 stores an elastic force energy that acts in the direction to the right in FIG. 6C, namely toward the back of the occupant. The link 38 stops inclining whenever the force of the occupant to recline against the link 38 is balanced by this elastic force, so that the reclining posture of the occupant is established.

When the occupant is seated on the chair seat 12 in the state shown in FIG. 6B, in case the occupant is seated with his or her back in contact with the chair back 14, the force exerted by his or her back to press the chair back 14 and the force exerted by the linkage 18 to press the chair back 14 oppose each other, thus compressing the compressive coil spring 30. Thus, the position of the chair back 14, namely the seating posture of the occupant is established, when the elastic force generated in the compressive coil spring 30 to press the chair back 14 rearward and the force exerted by the occupant's back to press the chair back 14 are balanced.

In case the modulus of elasticity of the compressive coil spring 30 is adjusted so as to generate an elastic force that is stronger than a level at which the linkage 18 can be regarded as a mere link when the occupant reclines against the cushion 36 of the chair back 14 so that the chair back 14 inclines rearward, the compressive coil spring 30 exerts a force in the direction of an arrow 98, thereby causing the articulation 78 to swivel in the direction of an arrow 100. As the articulation 78 swivels, the articulation 76 connected to the link 72 is displaced in the direction of an arrow 102, and the articulation 24 swivels in the direction of another arrow 104.

Due to the action of the auxiliary link mechanism described above, the helical spring 28 of the articulation 24 increases the urging force. The increase in the urging force causes the torque to increase which pushes the link 34 upward via the link 70. This causes the link 34 to swivel about the articulations 20 in the direction of an arrow 106, i.e. counterclockwise. As a result, the angle between the chair seat 12 and the chair back 14 increases so that the amount of expansion of the hip joint of the occupant increases during the reclining action, thereby making it possible to keep a posture that gives highly open feeling.

When the occupant stands up from the chair 10, the link 70 pushes the link 34 from below by the action of the helical spring 28, thereby generating the effect of helping him or her in standing up.

Figure 5:
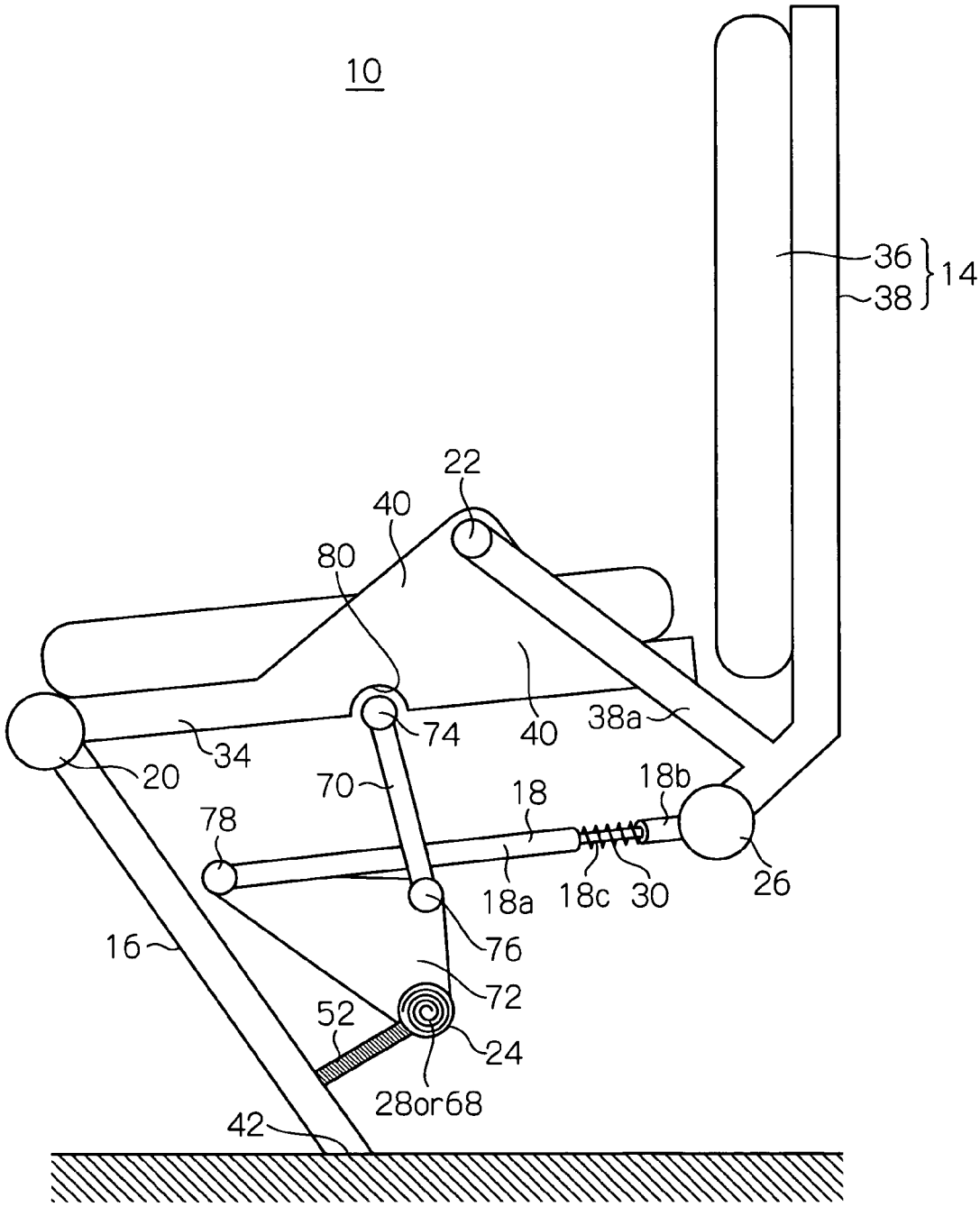

FIG. 5 through FIG. 6C show the link mechanism of the chair 10 in side views for the convenience of description, although the link mechanism may be covered by a casing or the like so that the occupant cannot view the mechanism.

The link mechanism may be structured in the form of modules detachable from the chair 10 which are designed, manufactured, repaired or replaced individually as link mechanisms for chair. The link mechanisms for chair may include the chair seat 12, the base member 16 and other peripheral components. It may be determined according to the level of modularization of the link mechanisms for chair to which extent specific peripheral components are to be included in the link mechanisms for chair.

In summary, the chair 10 of the present alternative embodiment is adapted to displace, as shown in FIGS. 6B and 6C, the chair seat 12 and the chair back 14 in coordination when the occupant is seated. Therefore, the occupant can always take the optimum seating posture.

The chair 10 of this embodiment also has the link mechanism, shown in FIGS. 5, 6A, 6B and 6C, disposed beneath the chair seat 12. The strength of the supporting force exerted when the chair seat 12 is caused to subside or the chair back 14 is caused to incline can be controlled by adjusting the modulus of elasticity of the helical spring 28, the torsion spring or the hydraulic shock absorber 68 of the link mechanism. That makes it possible to control the comfort of seating and the feel of using the chair 10 as desired.

The chair 10 of this embodiment is adapted to allow the chair back 14 to swivel about the articulations 22. Since the articulations 22 are disposed at a position that generally corresponds to the hip joint of the occupant when seated on the chair seat 12, it is made possible to rotate the chair back 14 about the hip joint of the occupant. As a result, the rotating motion of the chair back 14 can be preferably adapted to the anatomy of the human body so as to provide a better feel of seating on the chair 10.

Moreover, the chair 10 of the previous embodiment can help the occupant in a series of actions taken from seating to standing up, as described below. First, since the link 34 of the chair seat 12 is inclined forward, the occupant is supported by the seat surface from the early stage of seating so as to decrease the stress on his or her body, particularly on the buttocks. Also because the chair seat has its apparent depth shorter before the occupant sits thereon, he or she can easily find the seating position and be seated deeper toward the rear of the chair seat, so that he or she can sit in a proper posture. At this time, although the chair seat is inclined forward, the chair back rises substantially at right angles with respect to the ground and it is therefore easy for him or her to have the back fit when seated on the chair.

Second, when the occupant is seated, the chair back 14 automatically fits to his or her back. As the occupant reclines so that the chair back 14 inclines rearward, the chair seat 12 and the chair back 14 change in accordance with the posture of the occupant so as to keep him or her in the optimum posture. In case the modulus of elasticity of the compressive coil spring 30 is set to a value of reactive force that is stronger than a level at which the linkage 18 can be regarded as a mere link during the course of reclining, the chair seat 12 is pushed upward when the chair back 14 is inclined rearward, so that the angle between the chair seat 12 and the chair back 14 increases, thus making it possible for the occupant to extend his or her body and take a relaxed posture. Third, when the occupant stands up, the chair seat 12, by means of the link mechanism disposed beneath, presses him or her upward and helps him or her in standing up.

Figure 7:
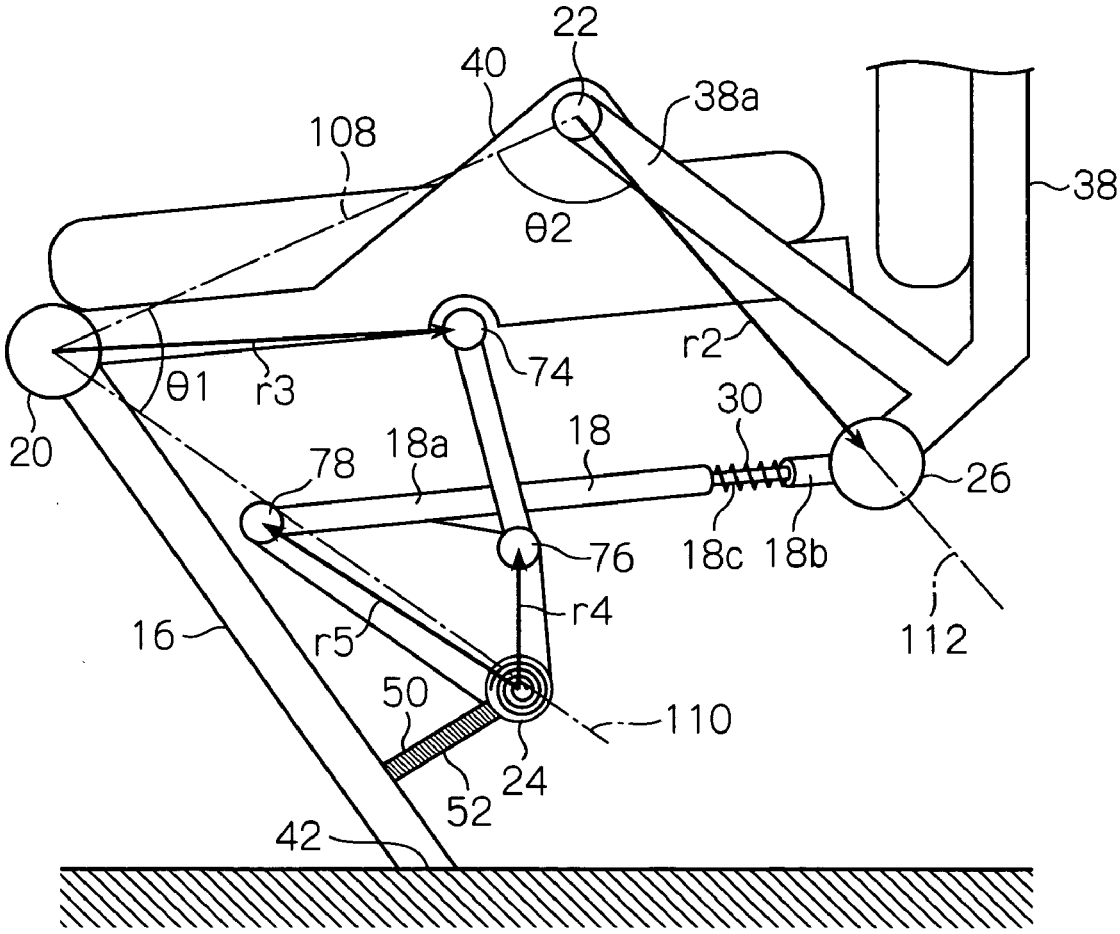
FIG. 7 is a diagram, like FIG. 3, schematically showing forces that act on the chair shown in FIG. 5.

Now, the chair 10 of this alternative embodiment shown in FIG. 7 will be compared with the illustrative embodiment shown in and described with reference to FIG. 3. In case the forces r2 shown in FIGS. 3 and 7 are the same as each other, the force r1 shown in FIG. 3 is defined by the expression (1).

$$R1=(r3/r4)r5 \quad (1)$$

The force r1 acts in the direction from the articulations 20 to the articulation 24, as shown in FIG. 3. The force r2 acts in the direction from the articulations 22 to the articulation 26. The force r3 acts in the direction from the articulations 20 to the articulation 74. The force r4 acts in the direction from the articulation 24 to the articulation 76. The force r5 acts in the direction from the articulation 24 to the articulation 78.

In the expression also, θ1 is the angle formed between a dot-and-dash line 108 that connects the articulations 20 and 22 and a dot-and-dash line 110 that connects the articulations 20 and 24, and θ2 is the angle formed between the dot-and-dash line 108 and a dot-and-dash line 112 that connects the articulations 22 and 26 to each other.

When the forces r3, r4 and r5 are set to the relation as defined by the expression (1), a change in the angle θ2 for a change in the angle θ1 becomes equal between FIGS. 3 and 7. As a result, simply by seating on the chair seat 12, the occupant enjoys a feeling that the chair back 14 automatically fits to his or her back.

As described earlier, in general, when manufacturing the chair 10 that has the structure shown in FIG. 1, it is difficult to make the force r2 represented by the length of the articulations 22 and 26 smaller than a predetermined value. That is, in order that the articulations 22 generally coincide with the position of the hip joint of the occupant when seated on the chair seat 12, the articulations 22 are required to be provided at predetermined distances from the chair seat 12 and the chair back 14.

In the chair 10, the articulation 26 swivels about the articulation 24 similarly to the chair back 14. That is, when the occupant changes the posture, the chair back 14 swivels about the articulation 24 as he or she inclines. At this time, it is necessary to determine the position of the articulation 26 so that the articulation 26 and the lower end of the chair seat 12 do not interfere with each other. It is thus difficult to make the force r2 smaller than a predetermined value in order to constitute the link mechanism from members commonly available.

In order to practice the functions described in the illustrative embodiment described earlier, the magnitude of the force r1, and hence the length of the articulations 20 and 24, preferably satisfy the relation r1=r2. However, this implies that the base member 16 becomes longer correspondingly to the force r2. Since the base member 16 that satisfies this condition is longer than the dimension of the base member 16 which would include the ordinary chair legs and casters, it is difficult to keep the height of the chair seat to a level similar to that of ordinary chairs. This is of course applied also to the previous embodiment where it is preferred to simplify the link mechanism, when consideration is given to whether or not there is the restriction to keep the distance r1 shown in FIG. 3 sufficiently large.

The link mechanism shown in FIG. 7 is resultant from introducing the auxiliary link mechanism into the link mechanism of the previous embodiment and setting the force r1 so as to satisfy the relationship with forces r3, r4 and r5 as defined by the expression (1). Accordingly, the embodiment shown in FIG. 7 can achieve a function similar to that of the embodiment shown in FIG. 1. That makes it possible to reduce the size of the auxiliary link mechanism provided beneath the chair seat 12 so as to reduce the height of the chair seat 12 as comparable as the ordinary chairs. Thus, according to the illustrative embodiments, the link mechanism that produces elastic force to the chair 10 may be simplified in structure, thus rendering costs of the components and manufacturing reduced.

The chair 10 shown in FIG. 5 may be dealt with as the basic constitution, into which various components may be incorporated, as will be described below. The chair 10 shown in FIG. 8 may be resultant from adding the compressive coil spring 30 and the hydraulic shock absorber 68 shown in FIG. 4 to the chair 10 shown in FIG. 5. The chair 10 is capable of sufficiently resisting a contracting force, when applied, with the urging force in the linkage 18 as the link 38 swivels. Thus, it is made possible to cause the subsiding motion slower when the occupant is seated on the chair seat 12, thereby providing softer feel of seating.

The chair 10 shown in FIG. 5 may be adapted to provide the linkage 18 with the hydraulic shock absorber 68 to thereby make the reclining motion slower when the occupant reclines against the chair back 14, thus producing softer feel of reclining.

Figure 9:
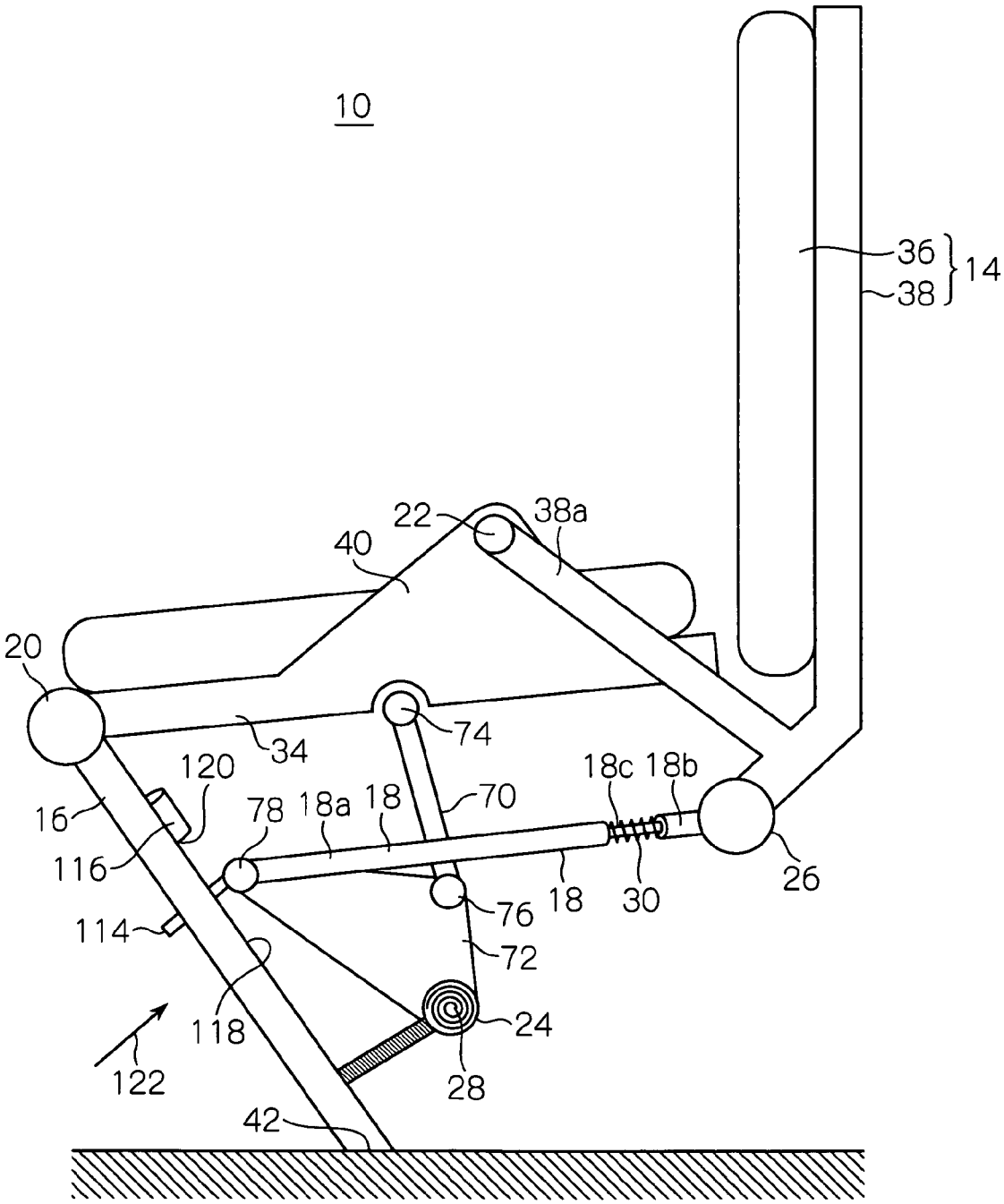
FIG. 9 is a schematic side view, like FIG. 5, of a further alternative embodiment where the chair shown in FIG. 5 additionally has a locking piece and a stopper provided.

FIG. 9 depicts the chair 10 having a constitution derived from providing the chair 10 shown in FIG. 5 with a locking piece 114 and a stopper 116. The chair 10 may receive an extremely heavy object placed on the chair seat 12. In such a case, the helical spring 28 of the articulation 24 may not bear the weight of the heavy object with the elastic force, the articulation 24 being forced to swivel beyond the tolerable range of swivel to eventually break. The locking piece 114 and the stopper 116 are used to limit the subsiding motion of the link 34 within a predetermined range.

The locking piece 114 is a plate-like member that protrudes from the base member 16 toward the front of the chair 10 from the proximity of the articulation 78 disposed at the front end of the link 72. The stopper 116 is a cylindrical rubber piece that is disposed, as shown in FIG. 9, on the inner side 118 of the base member 16 and on the upper position 120 higher than the locking piece 114 before seating.

Figure 10:
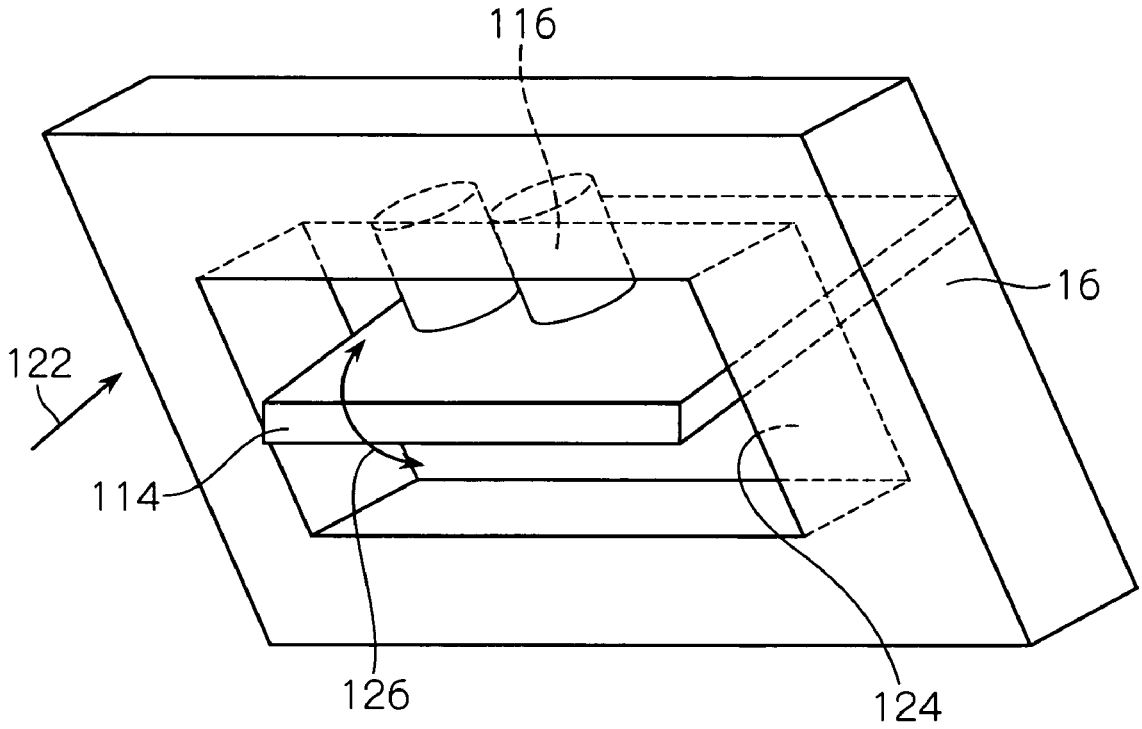
FIG. 10 shows in a perspective view the relation between the locking piece and the stopper that playably fit into a through hole formed in the base member of the chair shown in FIG. 9.

When the vicinity of the locking piece 114 of the chair 10 is viewed obliquely from below on the front as indicated by an arrow 122, the base member 16 has a through hole 124, FIG. 10, formed therein. The through hole 124 has its rectangular cross-section formed so as to fit the locking piece 114 playably therein. The locking piece 114 swivels about the articulation 78 as indicated by an arrow 126 in FIG. 10 within the through hole 124 formed in the base member 16.

Specifically, when the occupant is seated on the chair seat 12, the linkage 18 swivels clockwise on the sheet of FIG. 9. This swiveling motion causes the locking piece 116 to swivel similarly clockwise on the sheet. The locking piece 114 has the stopper 116 disposed on top 120 of the base member 18. Accordingly, the locking piece 114 swivels upward as indicated by an arrow 126 until it is brought into contact with the stopper 116 as shown in the figure. The swiveling motion is limited by the position where the stopper 116 is disposed.

As the linkage 18 swivels, the articulations 24, 76 and 78 of the auxiliary link mechanism correspondingly swivel. As a result, when the locking piece 114 touches the stopper 116 and is stopped thereby, the peripheral members are also prevented from swiveling further. Thus, the link 70 and the link 34 of the chair seat 12 stop subsiding at this point. Accordingly, the seating position of the occupant is established.

Figure 11A:
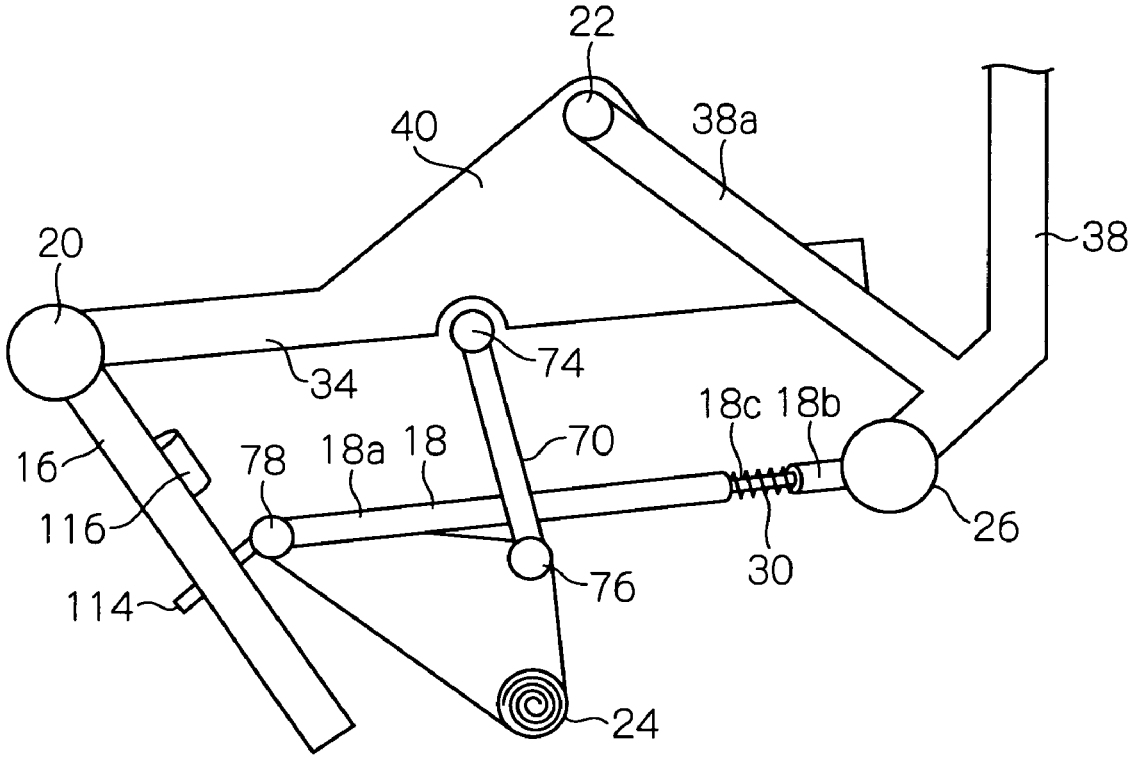
FIG. 11A is a schematic side view, like FIG. 2A, of the key portion of the chair shown in FIG. 9 before the occupant is seated thereon.
Figure 11B:
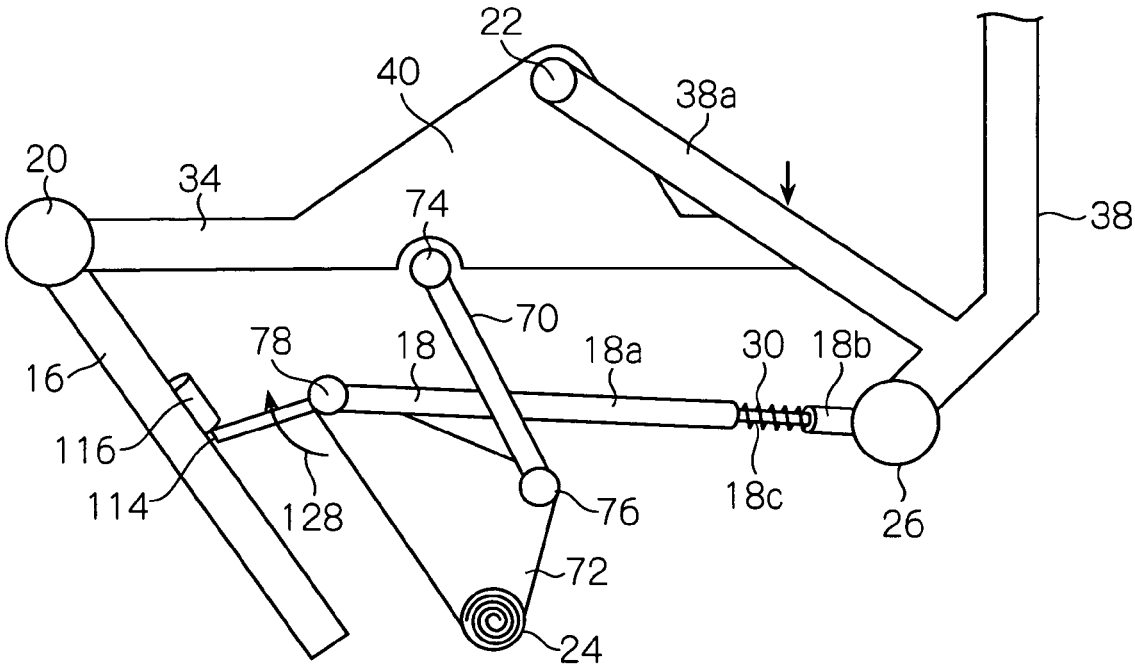
FIG. 11B is a schematic side view of the key portion of the chair shown in FIG. 9 in which the locking piece makes contact with the stopper.

The state before the occupant is seated on the chair seat 12 is shown in FIG. 11A, and the state in which the locking piece 114 makes contact with the stopper 116 so as to stop the rotation of the peripheral members is shown in FIG. 11B. When the occupant is seated on the chair seat 12, as shown in FIG. 6B, the locking piece 114 swivels clockwise on the sheet of FIG. 11B within a predetermined range together with the link 72 for each of the articulations 24, 76 and 78. As the components swivel, the locking piece 114 correspondingly swivels clockwise. When the locking piece 114 makes contact with the stopper 116, in the auxiliary link mechanism, the components is not allowed to further swivel in the clockwise direction indicated by an arrow 128, FIG. 11B, due to the actions of the locking piece 114 and the stopper 116. As a result, the chair seat 12 also stops subsiding at this point.

The cylindrical rubber is used as the stopper 116 in this alternative embodiment for the protection of other members. The stopper may not be limited to this specific example, but other types of member may be used as long as the swiveling of the locking piece 114 can be stopped.

In this alternative embodiment, as described above, the locking piece 114 and the stopper 116 are provided, and the articulation 78 caused to swivel clockwise over the predetermined range while the articulation 24 swivels clockwise renders the locking piece 114 and the stopper 116 to be brought into contact with each other to stop swiveling. As a result, when a very heavy object is placed on the chair seat 12, the components can be prevented from swiveling beyond the tolerable range of swivel, and hence from being damaged.

Figure 12:
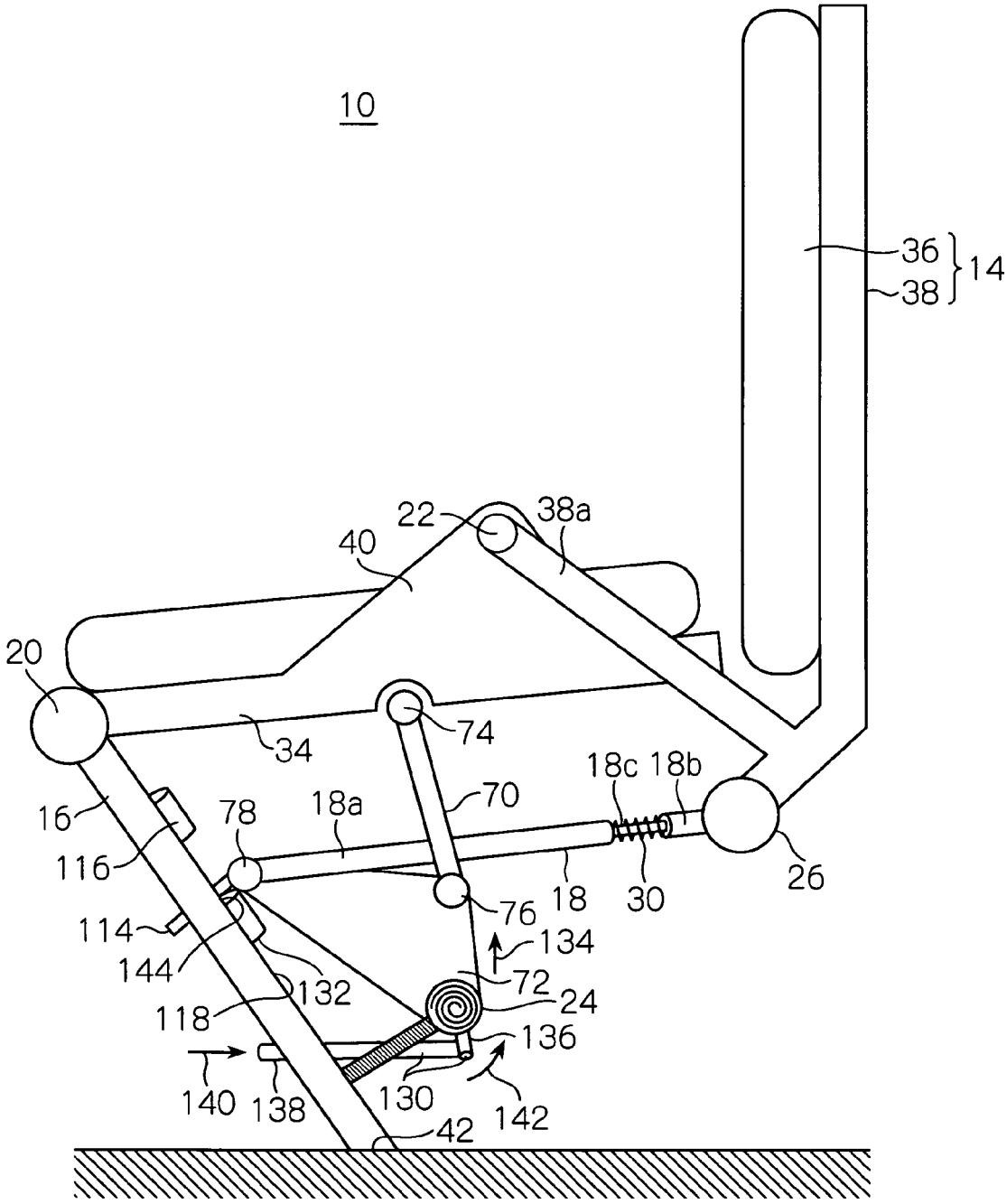
FIG. 12 shows in a schematic side view the relation between the locking piece that playably fits into a through hole formed in the base member and two stoppers in the chair shown in FIG. 9.
Figure 13:
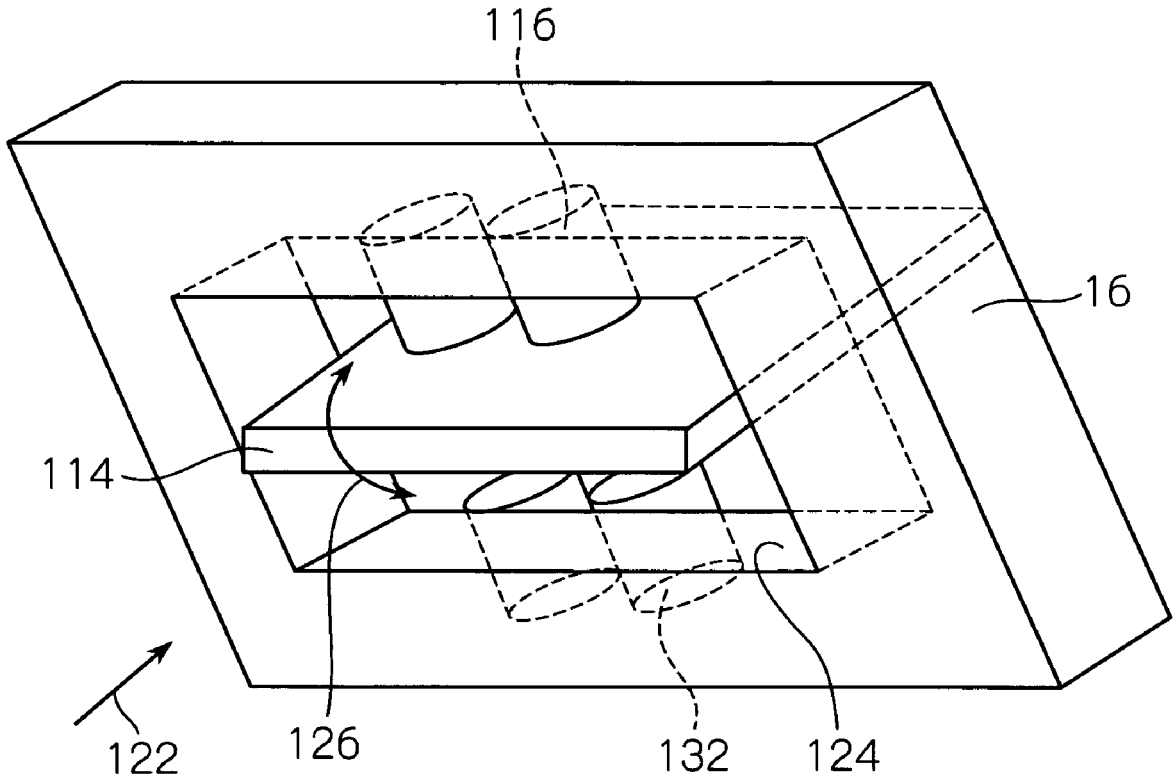
FIG. 13 shows in a perspective view, like FIG. 10, the relation between the locking piece that playably or freely fits into a through hole formed in a base member and two stoppers in the chair shown in FIG. 12.

FIG. 12 shows the chair 10 resultant from providing the chair shown in FIG. 9 with a mechanism for adjusting the urging force when the occupant is seated. As described previously, the chair 10 shown in FIG. 9 has the mechanism disposed therein which exerts an urging force upward from below the chair seat 12. The chair 10 shown in FIG. 12 has a pre-tensioner 130 and a stopper 132 as another urging force adjusting mechanism.

The pre-tensioner 130 has a function of using the urging force of the helical spring 28 to cause the articulation 24 to swivel by a predetermined amount in a direction of pushing the link 70 upward, as indicated by an arrow 134. The pre-tensioner 130 may comprise a protrusion 136 that protrudes in the radial direction of the helical spring 28. The pre-tensioner 130 has a linking member 138 which freely swivels the protrusion 136 together with itself by means of a shaft. Thus, the linking member 138 is pressed and adjusted by a predetermined amount from the front of the base member 16 toward the back, namely from the left to the right in the figure as indicated by an arrow 140. The pre-tensioner 130 presses the linking member 138 via a thrust screw. This pressing force causes the articulation 24 to swivel counterclockwise as indicated by an arrow 142.

As the stopper 132, a cylindrical rubber piece may be used. The stopper 132 is disposed at a position 144 at which the locking piece 114 is supported from below, on the inner side 118 of the base member 16. The operation of the stopper 132 will be described later on.

Then, when the vicinity of the locking piece 114 of the chair 10 is viewed obliquely from below on the front as indicated by an arrow 122, this alternative embodiment is different from the embodiment shown in and described with reference to FIG. 10 in that the stopper 132 is disposed below the locking piece 114. The downward swiveling of the locking piece 114 is limited within a predetermined range by the operation of the stopper 132.

Figure 14A:
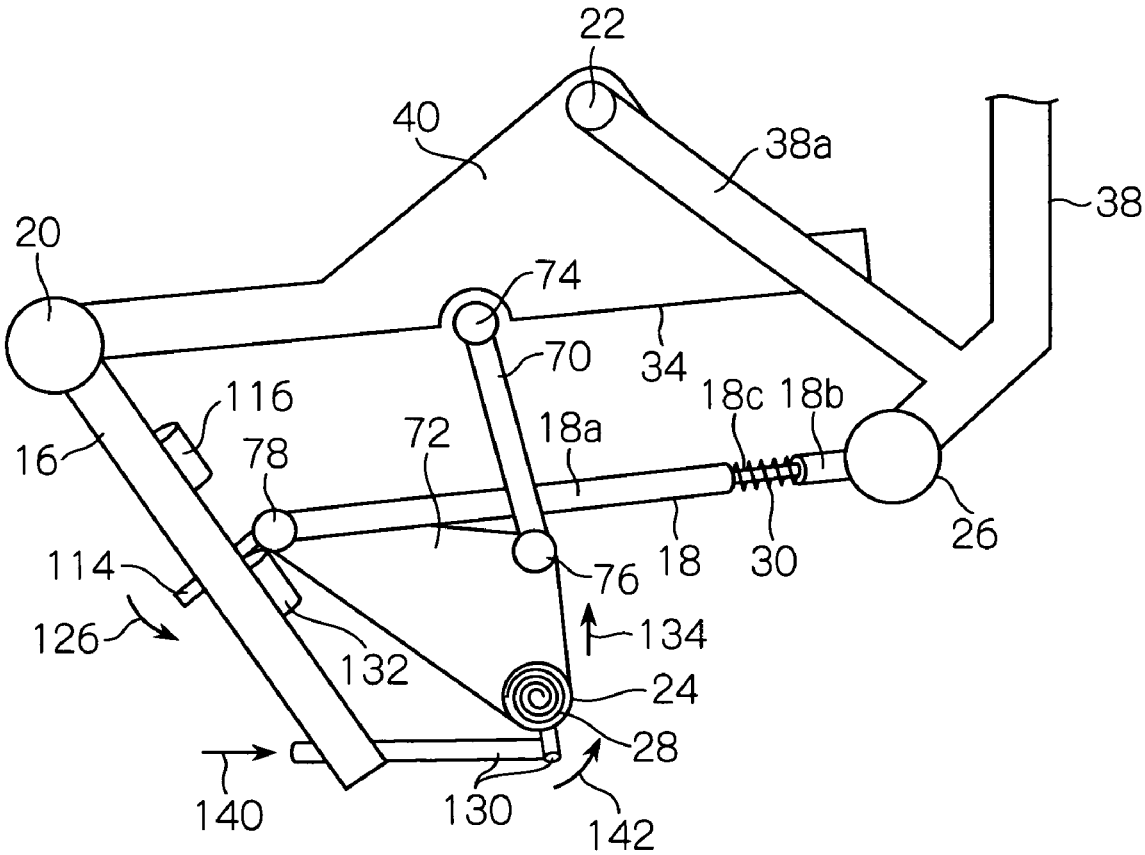
FIG. 14A is a schematic side view, like FIG. 11B, of the key portion of the chair shown in FIG. 13 in which the locking piece makes contact with the lower stopper.

The state before the occupant is seated on the chair seat 12 is shown in FIG. 14A. When the thrust screw is threaded in toward the right as indicated by an arrow 140 shown in FIG. 14A, the thrust screw presses the protrusion 136 of the pre-tensioner 130 that protrudes from the helical spring 28. The protrusion 136 that is pressed exerts a rotating force to swivel in the direction indicated by an arrow 142 about the articulation 24 that is disposed on the link 72. This swiveling motion causes the link 72 to receive a force that acts in the direction indicated by an arrow 134. Thus, the link 70 receives a force that acts in the direction of pushing it upward. As a result, the occupant receives a resisting force from below in the early stage of seating on the chair seat 12, so that the feel of seating can be adjusted by controlling the resisting force.

When the action of the pre-tensioner 130 generates a pressure in the direction indicated by an arrow 140 shown in FIG. 14A, the locking piece 114 and the peripheral members cause the arrow 126 to swivel downward, namely counterclockwise on the sheet of FIG. 14A. In order to restrict this swiveling motion within a predetermined range, the stopper 132 is disposed at an appropriate position where the locking piece 114 is brought into contact therewith. At the time the locking piece 114 and the stopper 132 make contact with each other, the locking piece 114 and the peripheral members stop swiveling. As a result, the chair 10 determines the position of the chair seat 12.

Figure 14B:
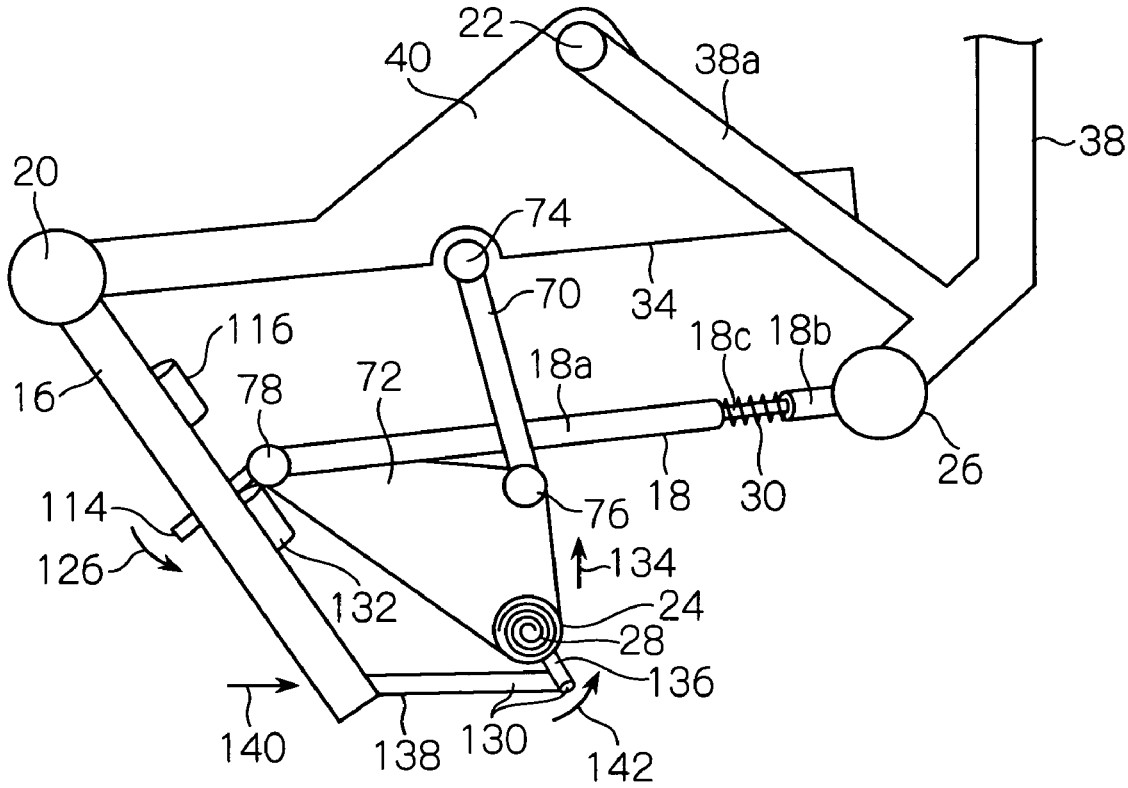
FIG. 14B is a schematic side view of the key portion and useful for understanding a motion caused as the chair shown in FIG. 13 shifts from the state in which the locking piece makes contact with the lower stopper to the state where the locking piece presses the lower stopper.

When the thrust screw of the pre-tensioner 130 is threaded further as shown in FIG. 14B, the locking piece 114 and the peripheral members do not swivel further although the helical spring 28 swivels further. Thus, the helical spring 28 increases its elastic force. When the occupant is seated on the chair seat 12, the chair seat 12 receives the force increasing to push it upward by way of the link 70. Thus, the pre-tensioner 130 is so adapted that the adjustment of the amount by which the thrust screw is thrust permits the resisting force acting from below when the occupant is seated on the chair seat 12 so as to control the feel of seating.

In this alternative embodiment described above, the pre-tensioner 130 is used to give the initial elastic force to the helical spring 28 so that a force acts to push the link 70 and the chair seat 12 upward. This makes it possible to produce a resisting force when the occupant is seated on the chair seat 12, thereby adjusting the feel of seating.

Also in this embodiment, the stopper 132 is used to limit the downward swiveling of the locking piece 114 and the peripheral members within a predetermined range. As a result, although the pre-tensioner 130 gives the initial elastic force to the helical spring so as to swivel, the swiveling stops depending on the position of the stopper 132, thus making it possible to adjust the initial position of the chair seat 12 as desired.

Further in this embodiment, it is made possible to adjust the amount by which the thrust screw of the pre-tensioner 130 is thrust in so as to control the initial elastic force of the helical spring 28, thereby controlling the resisting force when the occupant is seated on the chair seat 12. This can provide the chair 10 which has the chair seat 12 adjusted in the feel of seating. Since the amount by which the thrust screw is thrust in can be easily adjusted, the occupant per se can adjust the amount of thrusting to obtain a desired feel of seating.

Another alternative embodiment of the chair in accordance with the invention will be described with reference to FIG. 15. The instant alternative embodiment may be the same as the illustrative embodiment shown in and described with reference to FIG. 1 except that the side parts 146 are formed to hang over toward the front from the back of the link 38. The side parts 146 may operatively be connected by the respective articulations 22 of the side portions 40 protruded from the link 34.

Figure 15:
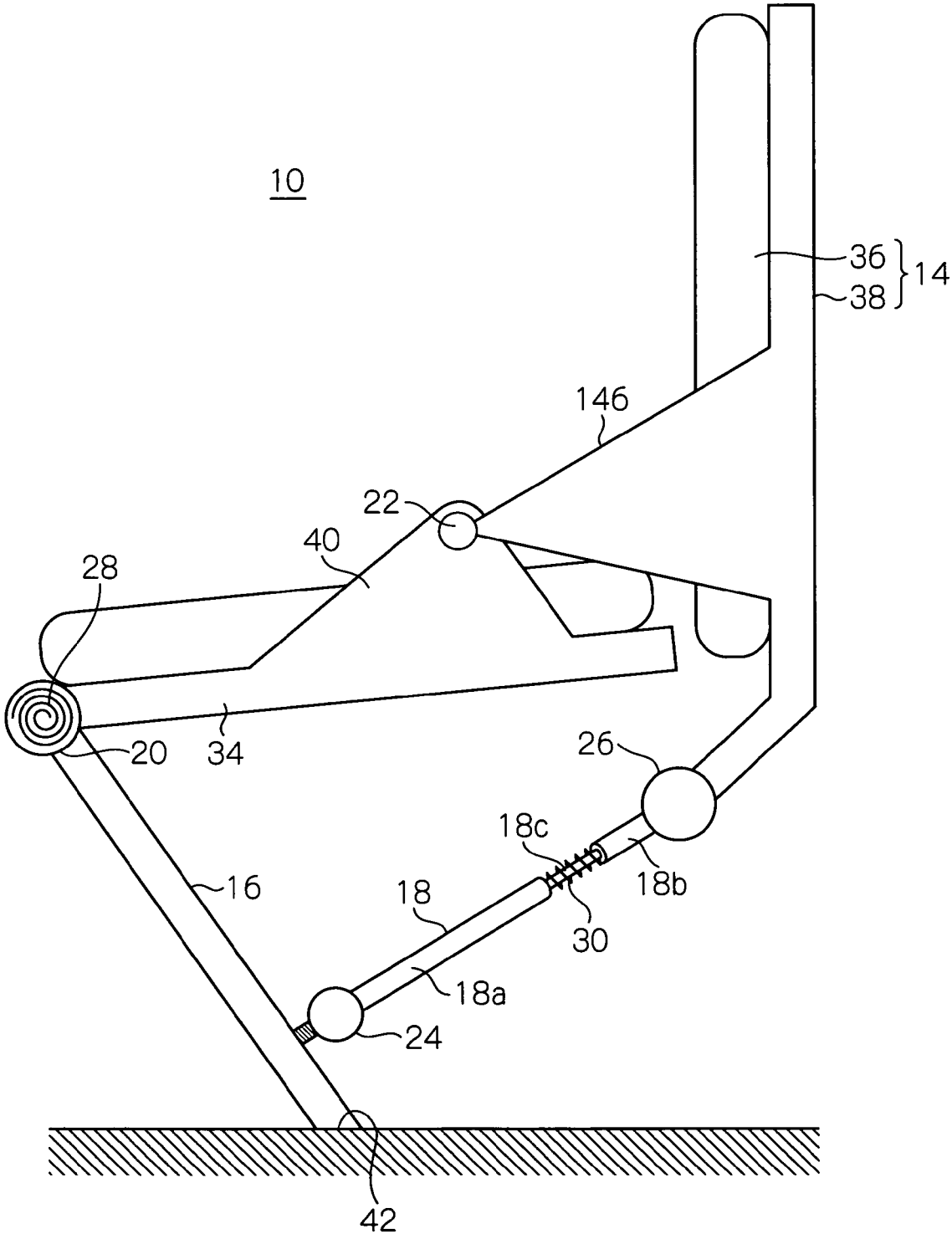
FIG. 15 is a schematic side view of the chair shown in FIG. 1 where the link of the chair back is extended to form side parts and swivels about the articulations provided on the side parts of the chair seat.

The chair 10 shown in FIG. 15 may also have an elastic member, like the hydraulic shock absorber 68, FIG. 4, besides the compressive coil spring 30 that is disposed in the linkage 18.

Figure 16:
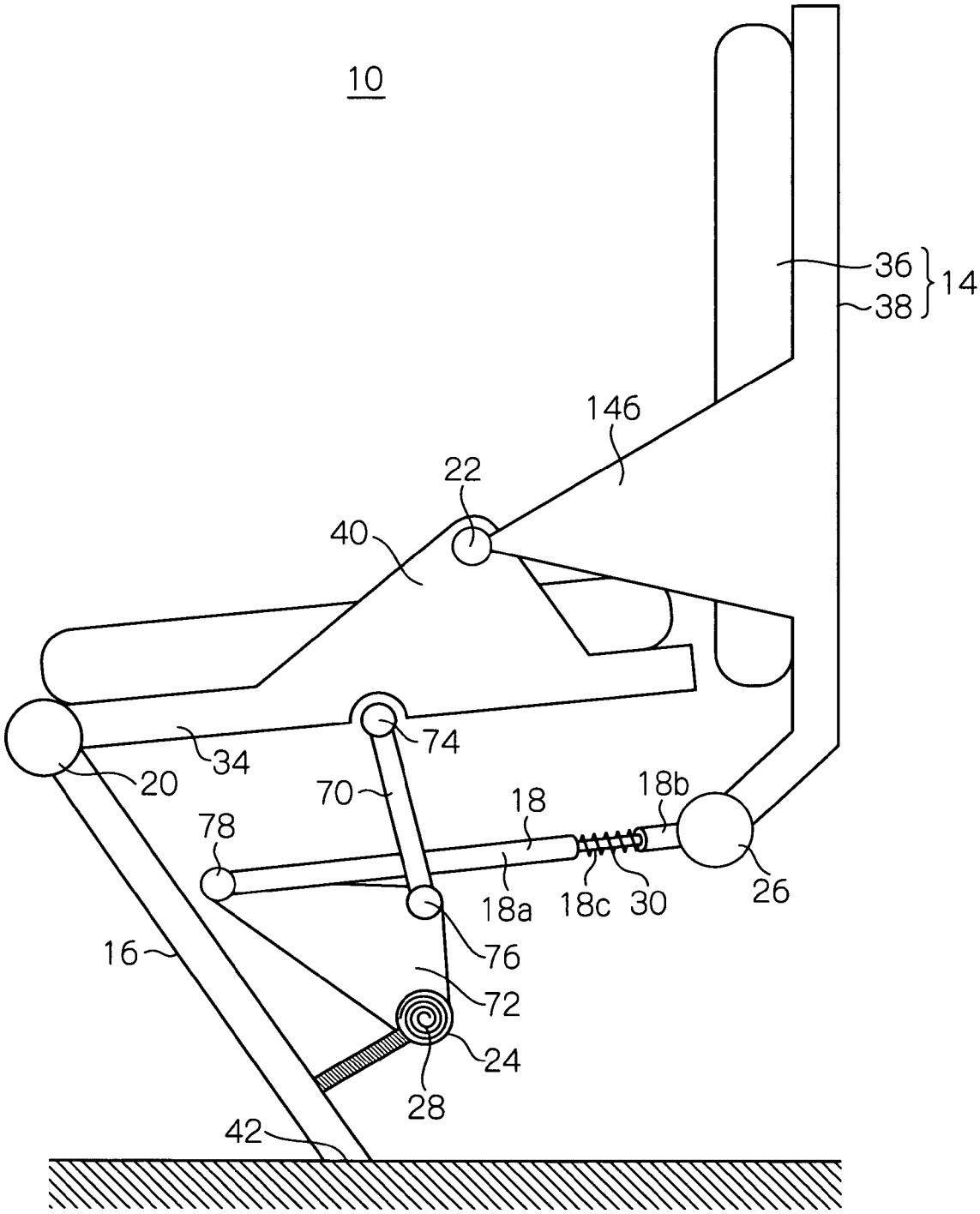
FIG. 16 is a schematic side view of the chair shown in FIG. 5 where the link of the chair back is extended to form side parts and swivels about the articulations provided on the side parts of the chair seat.

The chair 10 shown in FIG. 16 may be adapted by providing the chair 10 shown in FIG. 5 with the type of link 38 shown in FIG. 15.

Figure 8:
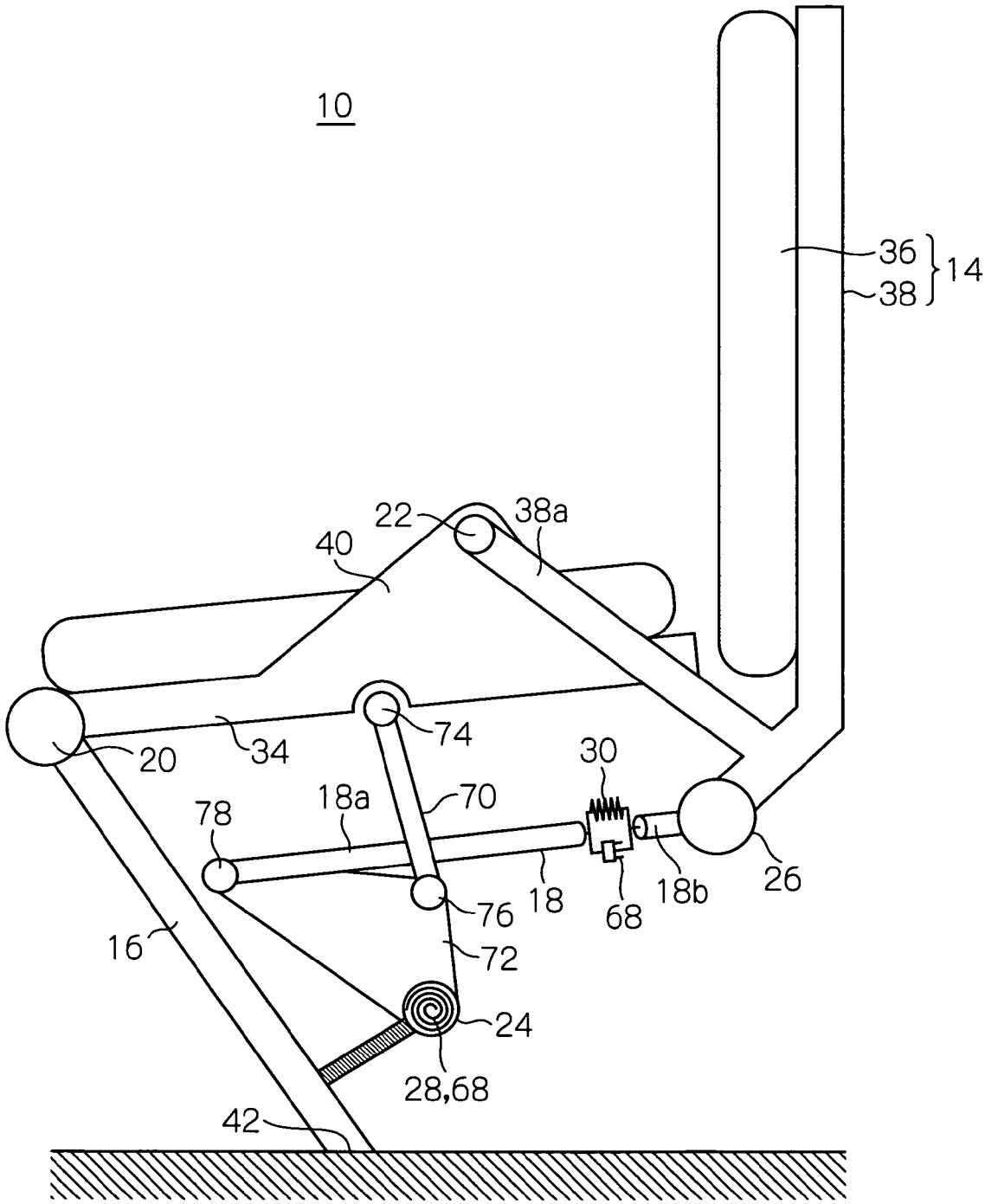
FIG. 8 is a schematic side view, like FIG. 5, of another alternative embodiment where the link mechanism of the chair shown in FIG. 5 additionally has a compressive coil spring and a hydraulic shock absorber used to generate an urging force.

The chairs 10 shown in FIGS. 8, 9 and 12 may have the link 38 shown in FIG. 15 applied thereto.

In the illustrative embodiments described so far, the chair 10 includes the articulations 20, 22, 24 and 26. The articulations 22 may have the helical spring 28 disposed therein for exerting an urging force in the swiveling direction. This allows the resisting force produced when the occupant reclines against the chair back 14 to be adjusted in cooperation with the compressive coil spring 30. Also, it is possible to adjust, in cooperation with the helical spring 28, the resisting force when the occupant is seated. Moreover, the chair 10 may employ the hydraulic shock absorber 68 for the articulation 24.

Figure 17:
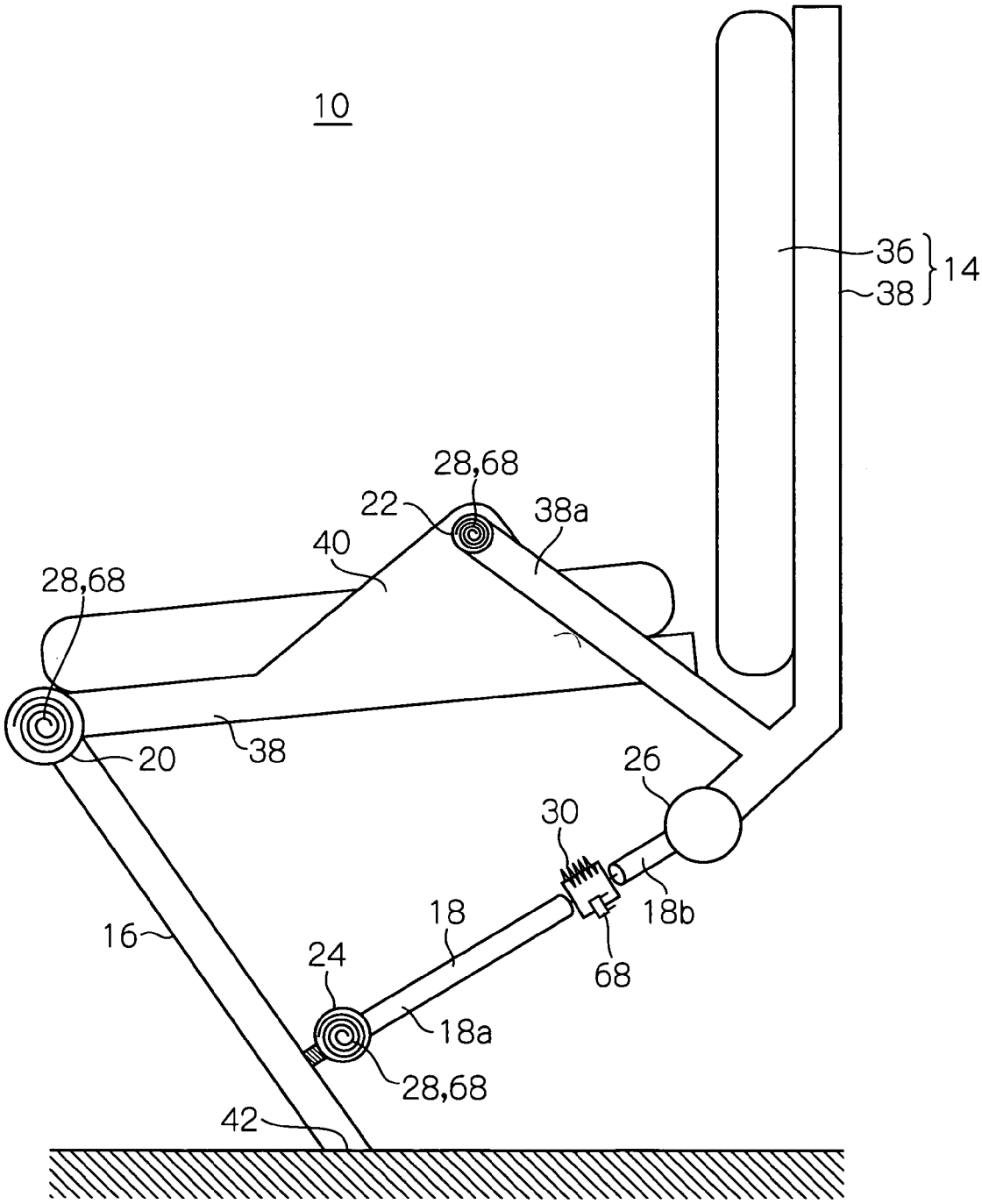
FIG. 17 is a schematic side view of the chair shown in FIG. 4 where a component is further provided for generating urging force in the two articulations.

The chair 10 shown in FIG. 17 may have the articulations 20, 22, 24 and 26 arranged. Although the helical spring 28 is used as the articulations 20, the hydraulic shock absorber 68 may be applied to the articulations 24, thus attaining the same effect as the embodiment shown in FIG. 1.

In the chair 10 shown in FIGS. 1, 4 and 15, either of the helical spring 28 and the hydraulic shock absorber 68 may be applied to the articulations 24.

The chair 10 shown in FIG. 17 corresponds to the chair 10 shown in FIG. 4 having the articulations 20, 22, 24 and 26 arranged. The figure illustrates all of the articulations 20, 22 and 24 and the linkage 18 having the helical springs or the hydraulic shock absorbers arranged. However, the chair 10 may be constituted by providing not all the articulations 20, 22 and 24 and the linkage 18 with helical springs or hydraulic shock absorbers but appropriately providing any of them as required by the specifications of the chair.

Figure 18:
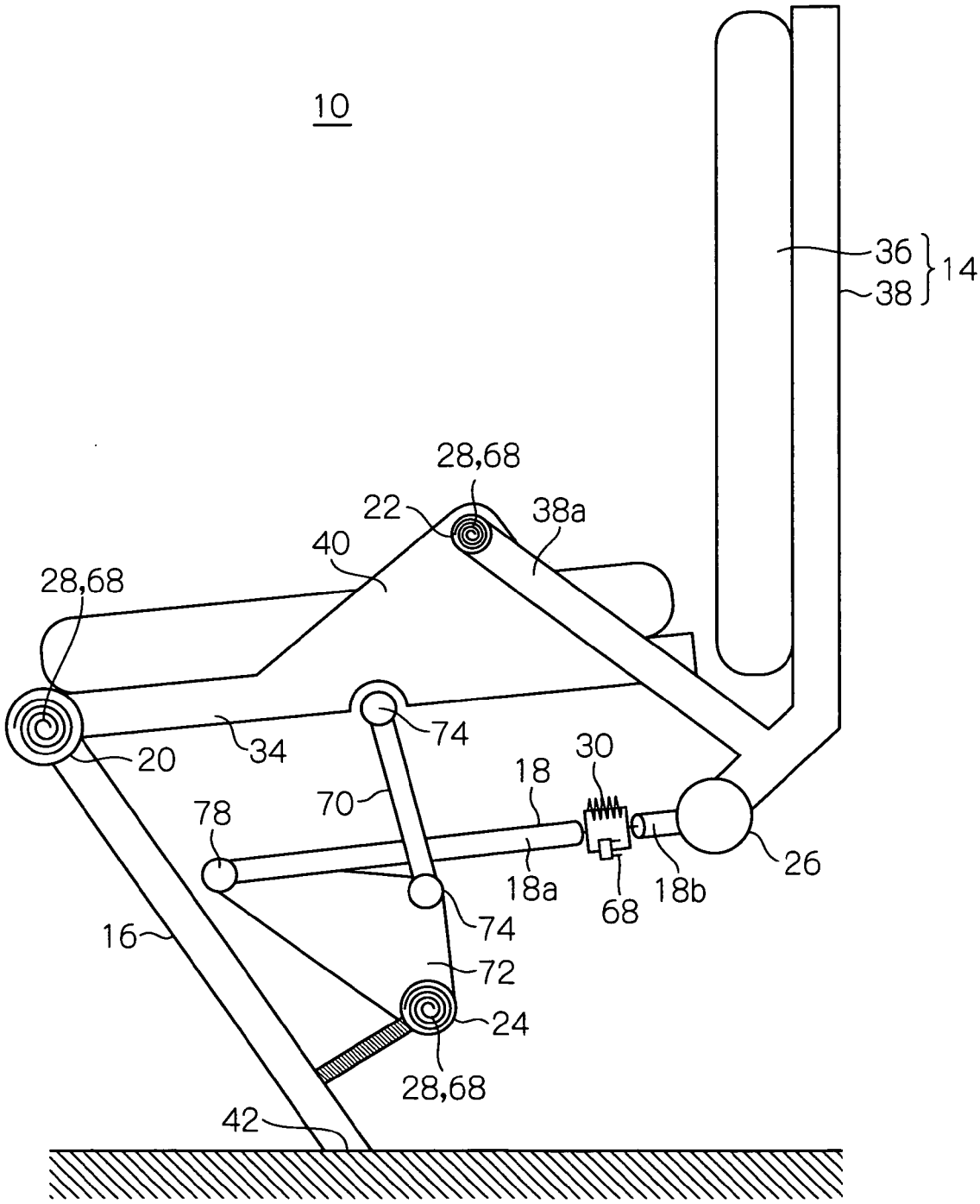
FIG. 18 is a schematic side view of the chair shown in FIG. 8 where a component is further provided for generating urging force in the two articulations.

The chair 10 shown in FIG. 18 corresponds to the chair 10 shown in FIG. 5 having the articulations 20, 22, 24 and 26 shown in FIG. 17 arranged. The helical spring 28 that generates the urging force in the swiveling direction is disposed for the articulation 24 in this embodiment. However, the same effect as the chair 10 shown in FIG. 5 can be achieved also by using the helical spring as the articulations 20. As in the chair 10 shown in FIG. 18, helical springs may also be provided for both of the articulations 20 and 24.

The chair 10 shown in FIG. 8 has the hydraulic shock absorber 68 that gives viscous resistance as the urging force to the articulation 24. In this chair 10, the hydraulic shock absorber 68 may be applied to the articulations 20, thereby achieving the same effect as the chair 10 shown in FIG. 8.

In the chair 10 where the auxiliary link mechanism is added to the link mechanism as shown in FIGS. 5, 8, 9, 12 and 16, either the helical spring 28 or the hydraulic shock absorber 68 may be used as the articulations 20.

The chair 10 shown in FIG. 18 has the helical spring and the hydraulic shock absorber provided for all of the articulations 20, 22 and 24 and the linkage 18. The chair 10 may however be constituted by providing not all the articulations 20, 22 and 24 and the linkage 18 with the helical spring and the hydraulic shock absorber but appropriately providing any of them as required by the specifications of the chair.

The link mechanisms used in these embodiments described above are linear links, to which the present invention may not be limited. It is to be understood that the figures showing these embodiments are only for illustrative and do not represent the actual dimensions or proportions of any portions of the chair 10.

The entire disclosure of Japanese patent application No. 2009-078539 filed on Mar. 27, 2009, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A chair, comprising:

a chair seat having a chair seat link;

a chair back having a chair back link;

a lifting mechanism that pushes up the chair seat link in response to a force that presses the chair back link to incline rearward;

a base member that supports the chair seat link;

a first articulation that connects the chair seat link to said base member so as to be vertically swingable; and a second articulation that swivelably connects the chair back link to the chair seat link, wherein said lifting mechanism comprises:

a first link having one end connected to the chair back link;

a second link that is connected at one end thereof to the chair seat link;

a third link to which other ends of said first link and said second link are connected;

a third articulation that swivelably connects said base member to said third link;

a fourth articulation that swivelably connects said first link to the chair back link;

a fifth articulation that swivelably connects the chair seat link to said second link;

a sixth articulation that swivelably connects said second link to said third link; and a seventh articulation that swivelably connects said first link to said third link.

2. The chair in accordance with claim 1, wherein said first articulation connects a front end of the chair seat link to an upper end of said base member.

3. The chair in accordance with claim 1, wherein said lifting mechanism is a link mechanism that connects the chair back link to said base member.

4. The chair in accordance with claim 3, further comprising:

a third articulation that swivelably connects said link mechanism to said base member; and a fourth articulation that swivelably connects said link mechanism to the chair back link.

5. The chair in accordance with claim 4, further comprising a forward inclining mechanism that, when said chair seat is pressed downward, decreases an angle between the chair seat link and the chair back link.

6. The chair in accordance with claim 4, further comprising a forward inclining mechanism that, when the chair seat link is pressed downward, causes said lifting mechanism to operate in a direction opposite to a direction of pushing up of the chair seat link that occurs in response to a pressing action, and decreases an angle between the chair seat link and the chair back link.

7. The chair in accordance with claim 4, wherein said lifting mechanism controls an angle between the chair seat link and the chair back link in response to a change in an angle between the chair seat link and said base member.

8. The chair in accordance with claim 1, further comprising either a compressive coil spring that generates an elastic resistance as an urging force against a force acting on said first link, or a hydraulic shock absorber that generates a viscous resistance as the urging force against the force that acts on said first link.

9. The chair in accordance with claim 1, further comprising either a helical spring that generates an elastic resistance acting in a direction opposite to swiveling as an urging force against a force that acts in response to swiveling due to a force acting on said third articulation, or a hydraulic shock absorber that generates a viscous resistance in a direction opposite to swiveling as the urging force against the force that acts in response to swiveling due to the force acting on said third articulation.

10. The chair in accordance with claim 1, further comprising either a helical spring that generates an elastic resistance acting in a direction opposite to swiveling as an urging force against a force that acts in response to swiveling due to a force acting on said first articulation, or a hydraulic shock absorber that generates a viscous resistance acting in a direction opposite to swiveling as the urging force against the force that acts in response to swiveling due to the force acting on said first articulation.

11. The chair in accordance with claim 1, further comprising either a helical spring that generates an elastic resistance acting in a direction opposite to swiveling as an urging force against a force that acts in response to swiveling due to a force acting on said second articulation, or a hydraulic shock absorber that generates a viscous resistance acting in a direction opposite to swiveling as the urging force against the force that acts in response to swiveling due to the force acting on second third articulation.

12. A chair, comprising:

a chair seat, having a chair seat link;

a chair back, having a chair back link;

a base member that supports the chair seat link;

a first articulation that connects the chair seat link to said base member so as to be vertically swingable;

a second articulation that swivelably connects the chair back link to the chair seat link;

a lifting mechanism that pushes up the chair seat link in response to a force that presses the chair back link to incline rearward, said lifting mechanism being a link mechanism that connects the chair back link to said base member;

a third articulation that swivelably connects said link mechanism to said base member; and a fourth articulation that swivelably connects said link mechanism to the chair back link, wherein said lifting mechanism controls an angle between the chair seat link and the chair back link in response to a change in an angle between the chair seat link and said base member.

13. The chair in accordance with claim 12, further comprising a mechanism that, when the chair back link is pressed in a reclining direction, tilts the chair seat link in a direction to increase an angle between the chair back link and the chair seat link.

14. The chair in accordance with claim 12, wherein the chair seat link is fixed in an attitude inclined against a horizontal plane when no force is applied thereto.

15. The chair in accordance with claim 12, further comprising an auxiliary link mechanism that helps an occupant when standing up by pushing the chair seat link upward from beneath said chair in accordance with the occupant's standing up from the chair seat link.

16. The chair in accordance with claim 12, further comprising a forward inclining mechanism that, when said chair seat is pressed downward, decreases an angle between the chair seat link and the chair back link.

17. The chair in accordance with claim 12, further comprising a forward inclining mechanism that, when the chair seat link is pressed downward, causes said lifting mechanism to operate in a direction opposite to a direction of pushing up of the chair seat link that occurs in response to a pressing action, and decreases an angle between the chair seat link and the chair back link.

* * * * *